US007472903B2

(12) United States Patent
Nakakita et al.

(10) Patent No.: US 7,472,903 B2
(45) Date of Patent: Jan. 6, 2009

(54) SHEET FEEDER

(75) Inventors: Satoru Nakakita, Nagoya (JP); Takashi Ohama, Nagoya (JP); Toshitaka Iwago, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 479 days.

(21) Appl. No.: 11/276,792

(22) Filed: Mar. 14, 2006

(65) Prior Publication Data

US 2006/0220300 A1 Oct. 5, 2006

(30) Foreign Application Priority Data

Mar. 16, 2005 (JP) ..... 2005-075497
Mar. 16, 2005 (JP) ..... 2005-076105

(51) Int. Cl.
*B65H 3/06* (2006.01)
*B65H 3/52* (2006.01)

(52) U.S. Cl. ..... 271/114; 271/116; 271/121

(58) Field of Classification Search ..... 271/114, 271/116, 121
See application file for complete search history.

(56) References Cited

U.S. PATENT DOCUMENTS 650,410 A * 5/1900 Morin ..... 271/121
4,030,722 A * 6/1977 Irvine et al. ..... 271/10.13
5,259,607 A * 11/1993 Hironori et al. ..... 271/10.13
5,423,526 A * 6/1995 Hasegawa ..... 271/10.13

FOREIGN PATENT DOCUMENTS

| | | | |
|---|---|---|---|
| JP | 8101460 | A | 4/1996 |
| JP | 2000296927 | A | 10/2000 |
| JP | 2001018421 | A | 1/2001 |
| JP | 2001019272 | A | 1/2001 |
| JP | 2001022137 | A | 1/2001 |
| JP | 2002029639 | A | 1/2002 |

* cited by examiner

*Primary Examiner*—David H Bollinger
(74) *Attorney, Agent, or Firm*—Baker Botts L.L.P.

(57) ABSTRACT

A sheet feeder includes a roller configured to feed a plurality of sheets one by one in a sheet feeding direction to a feed path, and a motor configured to drive the roller. The sheet feeder also includes a drive transmission mechanism configured to transmit a driving force from the motor to the roller, and the drive transmission includes a clutch configured to enable the roller to rotate within a predetermined range of rotation in the sheet feeding direction during an idle condition. Moreover, the sheet feeder includes a return mechanism configured to enable the roller to rotate within the predetermined range of rotation in a direction that is opposite to the sheet feeding direction.

25 Claims, 27 Drawing Sheets

SHEET FEEDER

CROSS REFERENCE TO RELATED APPLICATION

This application claims priority from Japanese Patent Application No. 2005-75497, filed in Japan on Mar. 16, 2005, and Japanese Patent Application No. 2005-76105, filed on Mar. 16, 2005, and the disclosures of which these are incorporated herein by reference in their entirety.

BACKGROUND

1. Field of the Invention

The present invention relates to a sheet feeder configured to separate, one by one, sheets from a plurality of sheets held by a sheet supply tray and to feed the separated sheets to a conveying path.

2. Related Art

Known copiers, scanners, printers, and multifunction apparatus combining copier, scanner, and printer functions include an ADF (automatic document feeder) that feeds a sheet from a sheet supply tray via a conveying path to a sheet ejection tray. Such a known ADF includes a feeder that separates held by a sheet supply tray and feeds the sheets to a conveying path successively.

For example, as shown in FIG. 14, a sheet feeder 91 included in a known ADF 90 is formed with a pickup-side chute portion 93 connected to a sheet supply tray 92 used for placing sheets thereon. The pickup-side chute portion 93 includes a pickup roller 94, a pickup-side nip member 95, a separation roller 96, and a separation nip member 97.

The pickup roller 94 is rotatably disposed on a lower guide surface of the pickup-side chute portion 93. On an upper guide surface of the pickup-side chute portion 93, which is an opposite position of the pickup roller 94, the pickup-side nip member 95 is disposed to make contact with and separate from the pickup roller 94, and is urged by a spring member, not shown, in contact with the pickup roller 94. Sheets set in the sheet supply tray 92 are urged by the pickup-side nip member 95 toward the pickup roller 94. A lowermost sheet, which is pressed in contact with the pickup roller 94, is subject to a rotation of the pickup roller 94, and then is fed in a sheet feeding direction.

The separation roller 96 is rotatably disposed on the lower guide surface of the pickup-side chute portion 93 at a predetermined distance away from the pickup roller 94 with respect to the sheet feeding direction. On the upper guide surface of the pickup-side chute portion 93, which is an opposite position of the separation roller 96, the separation nip member 97 is disposed to make contact with and separate from the separation roller 96, and is urged by a spring member (not shown) in contact with the separation roller 96. The sheet fed by the pickup roller 94 is nipped between the separation roller 96 and the separation nip member 97, subjected to the rotation of the separation roller 96, and is fed in the sheet feeding direction.

On a downstream side from the pickup-side chute portion 93, a conveying path 98 having laterally-facing U shape is formed. The sheet supplied from the sheet supply tray 92 is fed along the conveying path 98 by conveying roller 99 and pinch rollers 100 disposed thereon. During the feeding process, the sheet is guided by a guide member 101 onto a platen glass 102, and an image scanner 103 reads an image of the sheet passing on the platen glass 102. After image reading, the sheet is ejected from the conveying path 98 to a sheet ejection tray 104.

To feed a sheet in the sheet feeding direction upon the rotation of the pickup roller 94 as described above, the sheet is inserted with its leading end inserted inward more than a nip position between the pickup roller 94 and the pickup-side nip member 95 when set in the sheet supply tray 92. If the pickup roller 94 and the pickup-side nip member 95 are in contact with each other, the user pushes the sheet to the nip position by withdrawing the pickup-side nip member 95, and further pushes the nipped sheet by causing the double sides to slide with respect to the pickup roller 94 and the pickup-side nip member 95.

However, if the user feels resistance at the nip position between the pickup roller 94 and the pickup-side nip member 95 during the sheet insertion, the user may mistake the position for an insertion limit position, and may finish inserting the sheet. In this case, the sheet is not completely set, and the sheet cannot be fed by the pickup roller 94. In addition, to set a plurality of sheets, the sheet may be bent at the nip position between the pickup roller 94 and the pickup-side nip member 95 because the plurality of sheets are flexible.

To address this issue, in another known ADF, when a plurality of sheets are set, either the pickup roller 94 or the pickup-side nip member 95 is withdrawn to provide a gap between the pickup roller 94 and the pickup side nip member 95, such that the sheet may be inserted. For example, as shown in FIG. 14, the pickup roller 94 protrudes or withdraws with respect to a guide surface of the pickup-side chute portion 93, and the pickup roller 94 is operated by a solenoid (not shown). In a situation when the sheet feeder 91 is not active, the pickup roller 94 is withdrawn to form a gap between the pickup roller 94 and the pickup-side nip member 95, so that insertion and removal of a plurality of sheets is facilitated. To feed the sheet after being set, the pickup roller 94 is protruded and the sheet are nipped between the pickup roller 94 and the pickup-side nip member 95. Then, upon the rotation of the pickup roller 94, the lowermost sheet is fed in the sheet feeding direction.

However, this known ADF increases the number of parts and increases the complexity of manufacturing the ADF, which increases the size of the ADF and the cost of manufacturing the ADF.

SUMMARY OF THE INVENTION

Therefore, a need has arisen for sheet feeders that overcome these and other shortcomings of the related art. A technical advantage of the present invention is that sheets may be separated and fed one by one without substantially increasing the size of the cost of the sheet feeder.

According to an embodiment of the present invention, a sheet feeder comprises a roller configured to feed a plurality of sheets one by one in a sheet feeding direction to a feed path, and a motor configured to drive the roller. The sheet feeder also comprises a drive transmission mechanism configured to transmit a driving force from the motor to the roller, and the drive transmission comprises a clutch configured to enable the roller to rotate within a predetermined range of rotation in the sheet feeding direction during an idle condition. Moreover, the sheet feeder comprises a return mechanism configured to enable the roller to rotate within the predetermined range of rotation in a direction that is opposite to the sheet feeding direction.

According to another embodiment of the present invention, a sheet feeder comprises an input tray configured to hold a plurality of sheets therein, a first roller configured to contact and to feed the plurality of sheets one by one in a sheet feeding direction to a feed path, and a first contact member configured to apply a pressure to the plurality of sheets in a direction toward the first roller. The sheet feeder also comprises a second roller disposed on a downstream side of the first roller, and the second roller is configured to feed the plurality of sheets fed by the first roller further in the sheet feeding direction. Moreover, the sheet feeder comprises a second contact member configured to contact the second roller and to separate the plurality of sheets fed by the first roller, and a motor configured to drive each of the first roller and the second roller. The sheet feeder further comprises a drive transmission mechanism configured to selectively transmit a driving force from the motor to each of the first roller and the second roller, and the drive transmission mechanism comprises a clutch configured to enable the first roller to rotate within a predetermined range of rotation in the sheet feeding direction during an idle condition. The sheet feeder also comprises a return mechanism configured to enable the first roller to rotate within the predetermined range of rotation in a direction that is opposite to the sheet feeding direction.

Other features and advantages of the present invention will be apparent to persons of ordinary skill in the art in view of the following detailed description of the invention and the accompanying drawings.

BRIEF DESCRIPTION OF THE DRAWINGS

For a more complete understanding of the present invention, the needs satisfied thereby, and the features and advantages thereof, reference now is made to the following descriptions taken in connection with the accompanying drawings.

DETAILED DESCRIPTION OF EMBODIMENTS

Embodiments of the present invention and their advantages may be understood by referring to FIGS. 1-27, like numerals being used for like corresponding parts in the various drawings.

Figure 1:
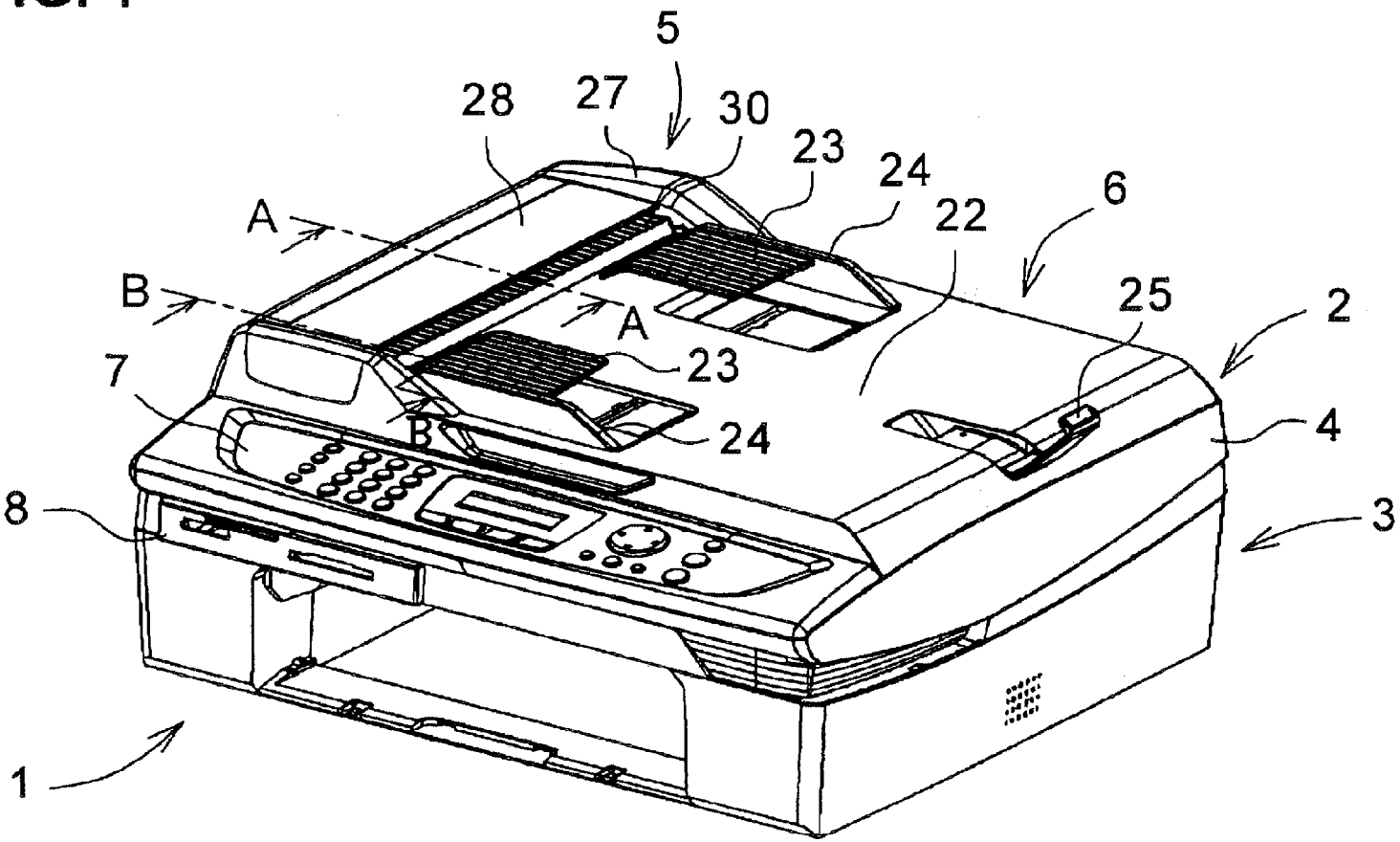
FIG. 1 is a perspective view of a complex machine according to an exemplar embodiment of the present invention.

FIG. 1 depicts a complex machine 1 according to a first embodiment of the present invention. The complex machine 1 may be a multifunction device (MFD) that integrally comprises a scanner function, a printer function, and a facsimile function. An upper portion of the complex machine 1 may be a scanner portion 2 for scanning an image of a sheet, such as a document, and a lower portion thereof may be a printer portion 3 for recording an image on a recording sheet. The sheet feeder according to an embodiment of the present the invention may be an ADF 5 in the scanner portion 2 of the complex machine 1. Thus, the sheet feeder according to an embodiment of the present invention may be used in a scanner alone, or may be used in a complex machine 1. Similarly, the sheet feeder may be used in a printer alone, a copier alone, or the like.

As shown in FIG. 1, the scanner portion 2 may comprise a document mounting table 4 that functions as a flatbed scanner (FBS), and a document holding cover 6 comprising an auto document feeder (ADF) 5, which may be attached to the document mounting table 4 via a hinge at a rear side so as to open and close. The document mounting table 4 may function as a housing of the complex machine 1, and a platen glass 20 (FIG. 2) may be disposed on a top surface opposite to the document holding cover 6. In addition, an image reading unit 21 may be built in the document mounting table 4 so as to face the platen glass 20. When the scanner portion 2 is used as the FBS, the document holding cover 6 may be opened so that a document may be placed on the platen glass 20, and may be closed so that the document is fixed on the platen glass 20.

After that, the image reading unit 21 reads an image by scanning the document on the platen glass.

On an underside of the document holding cover 6, a holding member 18 comprising a sponge or a white plate may be disposed to hold the document placed on the platen glass 20. Although this embodiment of the present invention has been described including a FBS function option, those of ordinary skill in the art readily will that the present invention may be used without the FBS function, e.g., a complex machine having the ADF5 alone.

The document holding cover 6 may be provided with the ADF 5 that continuously feeds documents from an input tray 22 to an output tray 23 via a feed path 26. In a process of feeding by the ADF 5, a document passes through a reading surface 19, where the image reading unit 21 scans an image of the document under the reading surface 19.

On a front side of the document mounting table 4, an operation panel 7 may be provided. The operation panel 7 comprises various keys and a liquid crystal display (LCD). The complex machine 1 may operate under a command using the operation panel 7. The complex machine 1 also may operate under a command sent from a computer connected to the complex machine 1 via a printer or a scanner driver, in combination with the command entered into the operation panel 5.

In an upper left portion of the front of the complex machine 1, a slot portion 8 configured to accept various compact memory cards, which are recording media, may be provided. Image data stored in a compact memory card inserted in the slot portion 8 is read, and information on the image data is displayed in the LCD, so that an image may be recorded on a recording sheet by the printer portion 3. Inputs for this may be performed from the operation panel 7.

Figure 2:
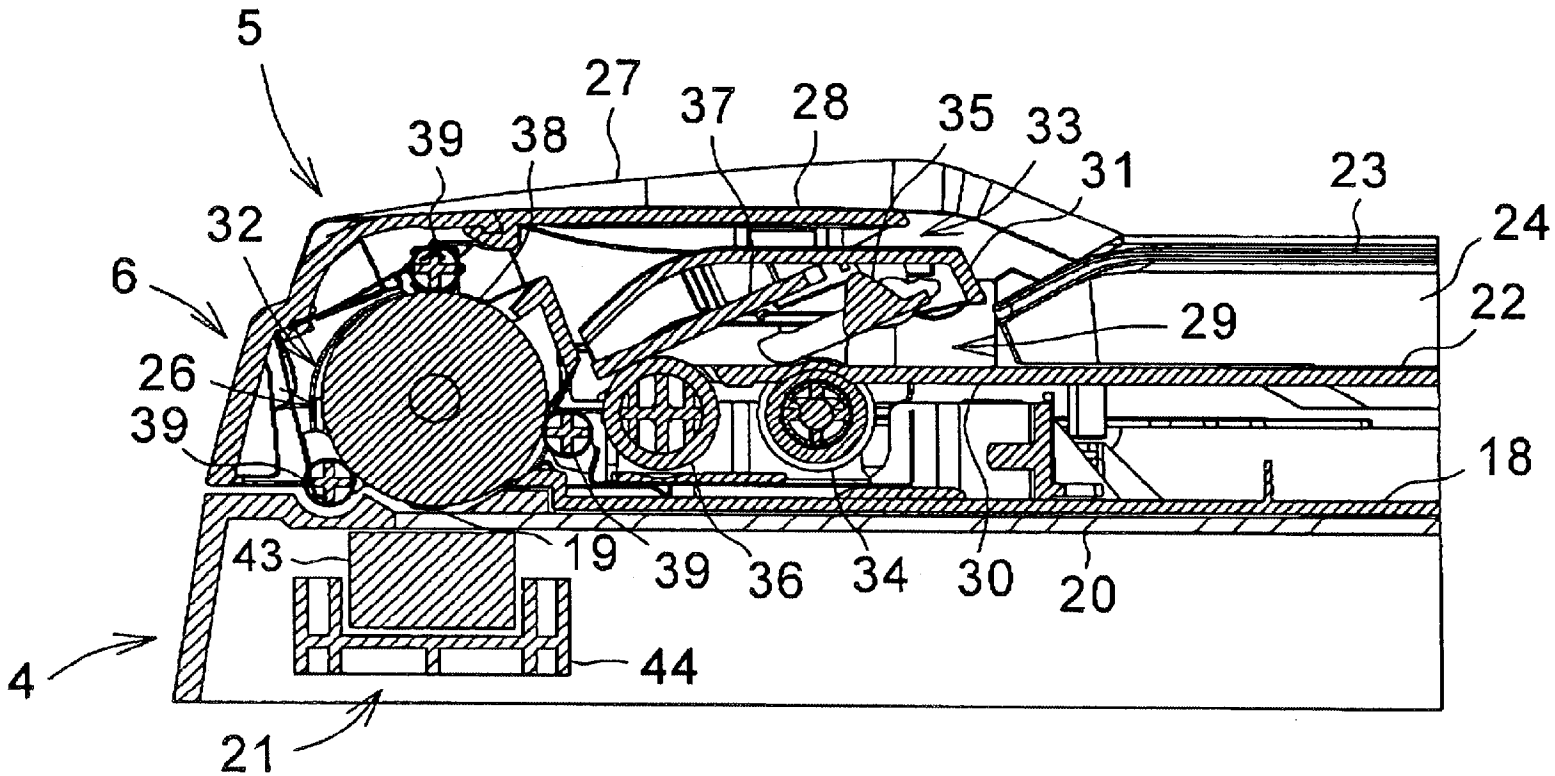
FIG. 2 is a cross-sectional view of an ADF 5, taken along the line A-A of FIG. 1, according to a first embodiment of the present invention.

As shown in FIGS. 1 and 2, the input tray 22 and the output tray 23 may be vertically arranged in a two-tiered manner on the document holding cover 6. The input tray 22 may be integrally formed with a top surface of the document holding cover 6. A plurality of documents to be read by the ADF 5 may be placed on the input tray 22 with leading ends of the documents, with respect to a sheet feeding direction, being inserted into the ADF 5. The input tray 22 may be provided with a pair of document guides 24 that are spaced from each other in a depth direction of the complex machine 1 and configured to slide in the depth direction. The document guides 24 stand from the input tray 22 to regulate a width of the documents to be placed on the input tray 22. When one of the pair of document guides 24 is slid, the other document guide 24 may slide in an opposite direction via any known interlocking mechanism.

For example, for a narrow document width, when one document guide 24, which is placed on the front side of the complex machine 1, slides toward the rear side, the other document guide 24, which is placed on the rear side of the complex machine 1, slides toward the front side. In this way, the document width may be adjusted narrowly by the pair of document guides 24 with reference to substantially a center with respect to the depth direction. In contrast, for a broad document width, when the document guide 24 on the front side slides toward the front side of the complex machine 1, the other document guide 24 on the rear side slides toward the rear side, so that the document width may be adjusted widely.

The output tray 23 may be formed with the pair of document guides 24 vertically away from the input tray 22. The documents ejected from the ADF 5 may be supported at both sides by the output tray 23, and may be retained independently from documents on the input tray 22. The output tray 23 may have a length, with respect to a sheet ejection direction, shorter than a length of the document. Thus, the leading end of an ejected document may be retained on the input tray 22 with trailing down from the output tray 23. As a result, although the leading end of the ejected document placed on the output tray 23 overlaps a trailing end side of documents placed on the input tray 22, the leading end of the documents on the input tray 22 and the trailing end of the documents on the output tray 23 may be retained in two tiers separately by the output tray 23, such that the document do not mix together. In addition, by making the output tray 23 short, a space necessary above the document holding cover 6 may be reduced, and the complex machine 1 may be made relatively thin and compact.

Figure 15:
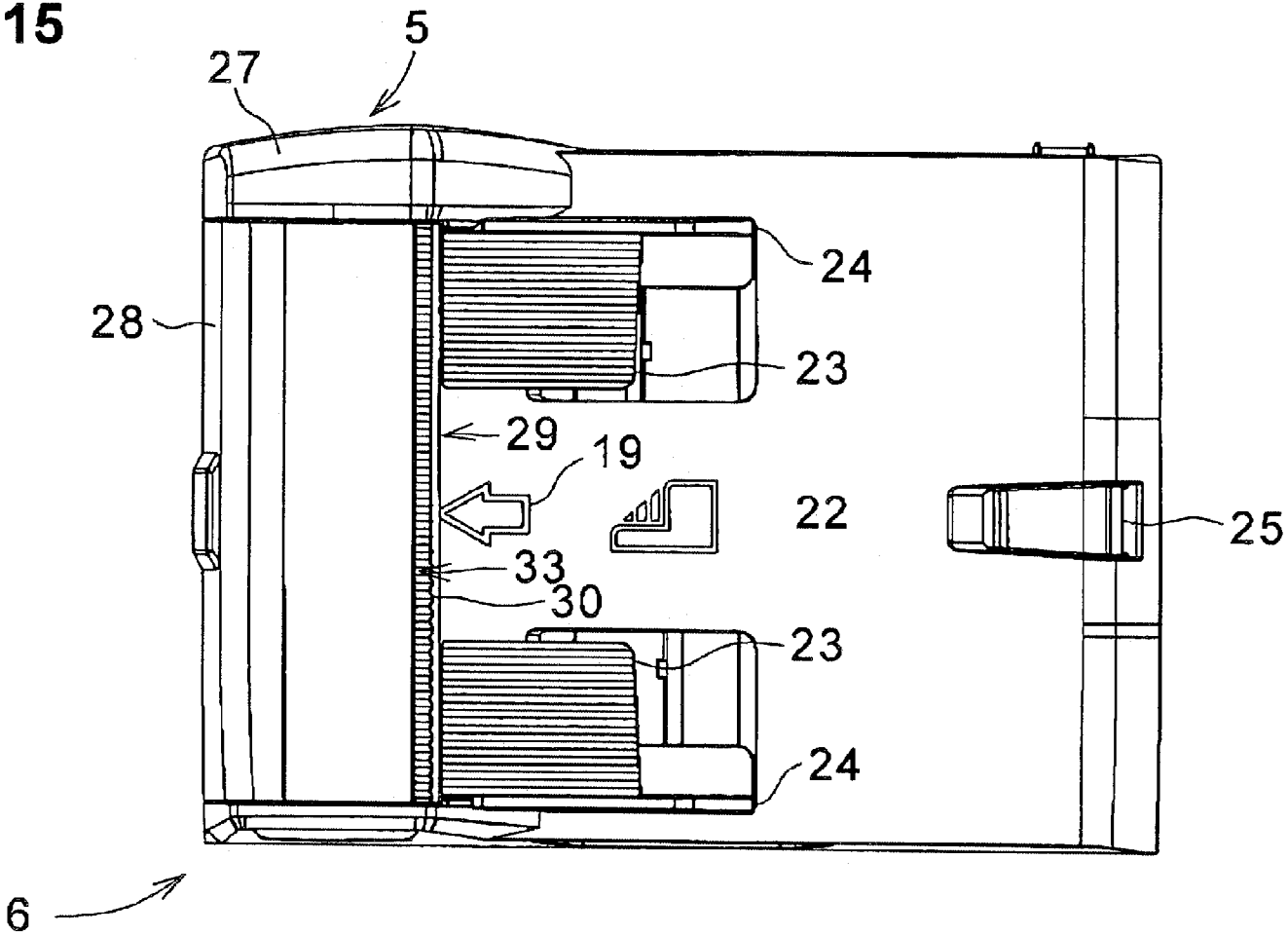
FIG. 15 is a plan view of a sheet holding cover 6.

As shown in FIG. 15, the input tray 22 may comprise an arrow 19 pointing in a direction to insert documents which are to be placed in the input tray 22. As described above, the output tray 23 may be provided above the input tray 22 and may be formed with the pair of document guides 24 to hold both side edges of documents ejected from the ADF 5. Thus, as shown in FIG. 15, the output tray 23 may not exist in the substantially central portion of the input tray 22 with respect to its width, so that the user can see the arrow 19 from an upper portion of the ADF cover 28.

Figure 3:
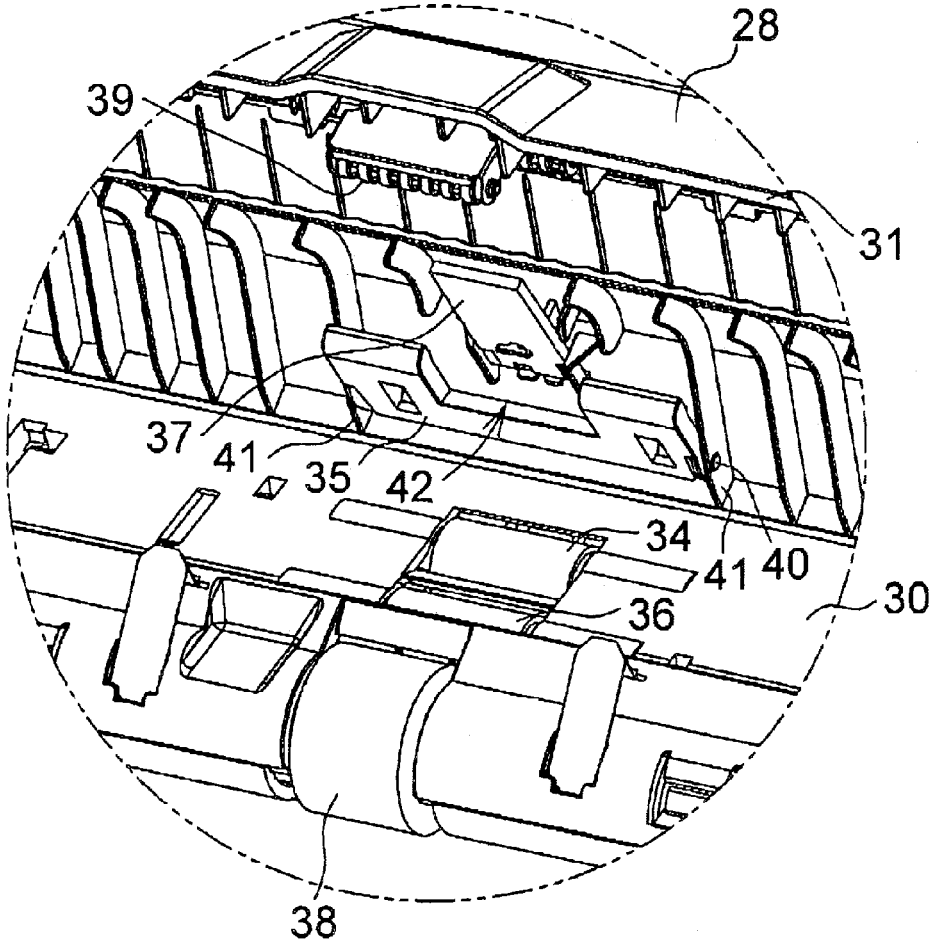
FIG. 3 is an enlarged perspective view when a cover of the ADF is open.

A pickup-side chute portion 29 may be formed from the input tray 22 to the inside of the ADF 5 (FIGS. 2 and 3), and documents to be read in the ADF 5 may be placed on the input tray 22 in such a manner that leading ends of the documents with respect to the sheet feeding direction are inserted into the pickup-side chute portion 29. As shown in FIG. 15, a part of a tip of the arrow 19 extends to the inside of the pickup-side chute portion 29, so that it is apparent that the position to insert documents is the pickup-side chute portion 29. Thus, the user may be deterred from incorrectly inserting the document, such as inserting the documents in the ejection chute portion 33 (FIG. 3). The arrow 19 may be printed or embossed on the input tray 22.

On an end of the input tray 22 where the ADF 5 is not provided, a document stopper 25 may be provided. The document stopper 25 may change its position between a standing position in which the document stopper 25 stands from the top surface of the input tray 22, and a folding position in which the document stopper 25 folds in alignment with the top surface of the input tray 22. When the document stopper 25 is placed in the standing position, for example, a document of a similar size as that of the input tray 22, which is ejected from the ADF 5, is stopped by the document stopper 25, such that the document may be prevented from slipping off the input tray 22. Thus, as the ejected document is received by the document stopper 25, the area of the input tray 22 may be made relatively small, and the document holding cover 6 may be made relatively compact. When the document stopper 25 is not used, the document stopper 25 may be placed in the folding position, so that the document stopper 25 does not protrude from the document holding cover 6, and the complex machine 1 may be made relatively compact in size when the complex machine 1 is packed in a box or placed in storage.

As shown in FIG. 2, inside the ADF 5, a feed path 26 may be formed in a substantially horizontal U shape to connect the input tray 22 and the output tray 23. The feed path 26 may comprise an ADF main body 27 integrally formed with the document holding cover 6, and an ADF cover 28 (a covering member) may be provided to the ADF main body 27 openably and closably. A pickup-side chute portion 29 of the ADF 5 may be as a passage having a predetermined height defined by a guide plate 30, which includes the input tray 22 and may be integrally formed with the ADF main body 27, and a partition plate 31, which may be disposed inside the ADF cover 28, as guide surfaces.

The feed path 26 may be formed in the substantially horizontal U-shape from the pickup-side chute portion 29 via a curved portion 32 to an ejection chute portion 33, and is continuously formed as a passage having a predetermined width defied by the curved portion 32, the ejection chute portion 33, the ADF main body 27, the ADF cover 28, the partition plate 31, and other parts. Thus, the documents set in the input tray 22 may be guided by the pickup-side chute portion 29, supplied to the feed path 26, and ejected from the ejection chute portion 33 to the output tray 23.

Feeding means for feeding the documents may be provided at the feed path 26. For example, the feeding means may comprise the pickup roller 34 (a first roller) and a pickup-side nip member 35 (a first contacting member) that presses into contact with the pickup roller 34, a separation roller 36 (a second roller), a separation nip member 37 (a second contacting member) that presses into contact with the separation roller 36, a feed roller 38, and pinch rollers 39 that press into contact with the feed roller 38. Nevertheless, the feeding means may be have other configurations, such as by changing the number of rollers or the position of the rollers or by using a pinch roller instead of each nip member.

In an embodiment of the feeding means comprises the pickup roller 34 disposed at the pickup-side chute portion 29, the pickup-side nip member 35, the separation roller 36, and the separation nip member 37.

FIG. 3 depicts the pickup roller 34, the pickup-side nip member 35, the separation roller 36, and the separation nip member 37 when the ADF cover 28 is open. As shown in FIGS. 2 and 3, the pickup roller 34 may be rotatably provided at substantially a center of the pickup-side chute portion 29, such that a part of its roller surface is exposed from the top surface of the guide plate 30. The separation roller 36 may be rotatably provided at a position away from the pickup roller 34 in a similar manner, such that a part of its roller surface is exposed from the top surface of the guide plate 30. The power from a feed motor 52 (FIG. 5) may be transmitted to the pickup roller 34 and the separation roller 36, and the pickup roller 34 and the separation roller 36 may be rotated. In addition, the pickup roller 34 and the separation roller 36 may be identical in diameter, and may be rotated at the same peripheral speed. A clutch 65 (FIG. 8) may be interposed in a path where power is transmitted to the pickup roller 34, and the pickup roller 34 may be configured to rotate idle within a predetermined range of rotation e.g. one turn.

The pickup-side nip member 35 may be provided at the partition plate 31 to face the pickup roller 34 and to pivot in directions to make contact with or to separate from the guide plate 30. The pickup-side nip member 35 may comprise a pad, which may be wider than a roller width of the pickup roller 34 with respect to its axial direction, and rotary shafts 40 may be formed at both sides of the pickup-side nip member 35 on an upstream side with respect to a sheet feeding direction. The rotary shafts 40 may be supported by ribs 41 formed on an underside of the partition plate 31, such that an end portion of the pickup-side nip member 35 on the downstream side with respect to the sheet feeding direction may be pivotally moved to contact the top surface of the guide plate 30. The pickup-side nip member 35 may be elastically urged downward by a spring member (not shown) and may be brought into contact with the guide plate 30 without a document nipped.

In this embodiment, the pickup-side nip member 35 is brought into contact with the guide plate 30. However, it is not necessary to bring the pickup-side nip member 35 into contact with the guide plate 30. The pickup-side nip member 35 may be placed in close proximity to the guide plate 30 if it is placed below the top position of the roller surface of the pickup roller 34. The pickup-side nip member 35 may comprise a roller instead of pad.

A cutout portion 42 may be formed through a portion of the pickup-side nip member 35 that contacts the pickup roller 34 on the downstream end of the pickup-side nip member 35 with respect to the sheet feeding direction. Thus, the pickup-side nip member 35 may be shaped in substantially a square bracket (an angular C-shape) which is open toward the downstream side with respect to the sheet feeding direction. The cutout portion 42 prevents the pickup-side nip member 35 from contacting the pickup roller 34, and end portions on both sides thereof may contact the top surface of the guide plate 30. Thus, with the pickup-side nip member 35 in contact with the top surface of the guide plate 30, the pickup roller 34 may be rotated in an idle condition.

The separation nip member 37 may be provided at the partition plate 31 to face the separation roller 36 and to pivot in directions to make contact with or to separate from the separation roller 36. The separation nip member 37 may comprise in a pad, which may be slightly narrower than a roller width of the separation roller 36 with respect to its axial direction, and may move pivotally on its upstream side with respect to the sheet feeding direction, such that a downstream end thereof with respect to the sheet feeding direction may contact the top surface of the guide plate 30. The separation nip member 37 may be elastically urged downward by a spring member (not shown) and may be pressed in contact with the roller surface of the separation roller 36 without a document nipped. The separation nip member 37 may comprise a roller instead of pad.

As shown in FIG. 2, the feed roller 38 may be disposed at the curved portion 32 of the feed path 26. The feed roller 38 may have an outside diameter, such that its roller surface forms a portion of the curved portion 32. The power from the feed motor 52 (FIG. 5) may be transmitted to the feed roller 38, and the feed roller 38 rotates.

Pinch rollers 39 may be provided at three places around the feed roller 38. Each pinch roller 39 may be elastically urged at its shaft by a spring member, and may be rotatably supported by the ADF main body 27 or the ADF cover 28, such that pinch roller 39 presses against the roller surface of the feed roller 38. When the feed roller 38 rotates, the pinch rollers 39 also rotates. A document may be pressed against the feed roller 38 by the pinch rollers 39, and a rotational force of the feed roller 38 may be transmitted to the document.

On a downstream side of the feed roller 38 with respect to the sheet feeding direction, the ejection chute portion 33 may be formed. The ejection chute portion 33 may be formed between the ADF cover 28 and the partition plate 31 so as to connect to the curved portion 32. Thus, documents supplied from the input tray 22 toward the feed path 26 may be fed to the pickup-side chute portion 29, then the curved portion 32, and then the ejection chute portion 33 and the documents then may be ejected to the ejection tray 23.

Figure 4:
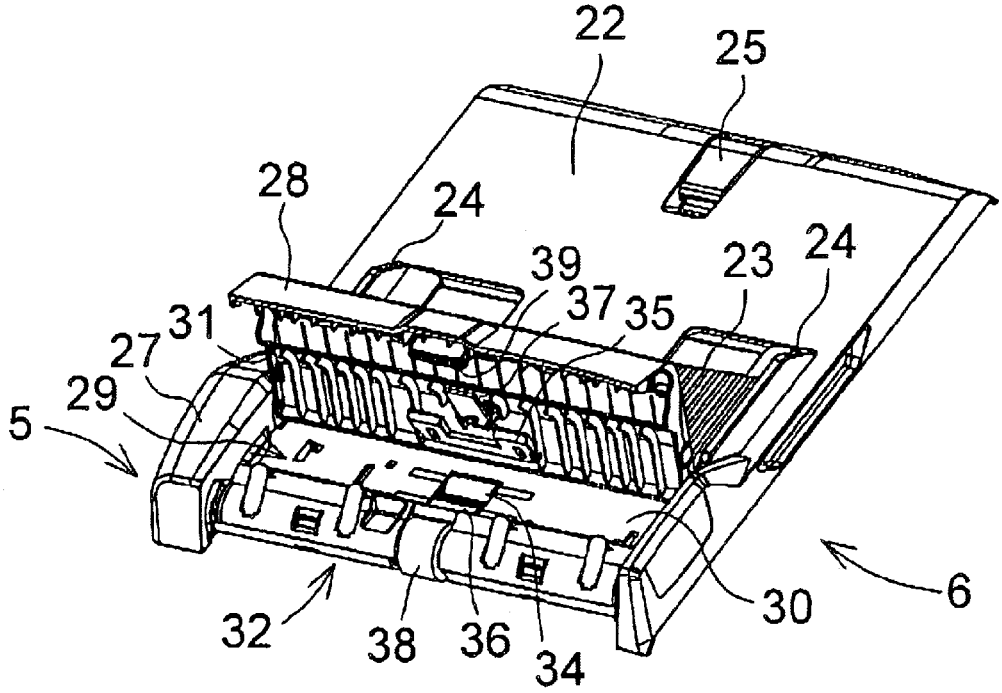
FIG. 4 is a perspective view of a document pressing cover when the ADF cover is open.

The ADF cover 28 may be fixed on the input tray 22 side and may be openable from the pickup roller 34 side, as shown in FIG. 4. By opening the ADF cover 28, the pickup-side chute portion 29 and the curved portion 32 are opened, the guide plate 30 and the partition plate 31 are sufficiently separated from each other, and the pickup roller 34 and the separation roller 36 are sufficiently separated from the pickup-side nip member 35 and the separation nip member 37. Thus, by opening the ADF cover 28, a paper jam in the feed path 26 may be cleared, and maintenance inside of the ADF 5 may be performed.

As shown in FIG. 2, the platen glass 20 may be disposed on the top surface of the document mounting table 4. The platen glass 20 is used for placing a document thereon when the scanner portion 2 is used as FBS. The platen glass 22 may be a transparent glass plate, for example. One end of the platen glass 20 reaches a lower portion of the feed roller 38 and operates as a reading surface 19 when the ADF 5 is used to read an image.

Inside the document mounting table 4, the image reading unit 21 may be embedded. As shown in FIG. 2, the image reading unit 21 may comprise a contact image sensor (CIS) unit 43, a carriage 44, and a scanning mechanism (not shown). The CIS unit 43 is a so-called contact image sensor that irradiates light to a document and converts reflected light from the document into electrical signals. The CIS unit 43 may be disposed at a position facing the feed roller 38, and may be oriented so that an axial direction of the feed roller 38 or the width direction of a document is a reading direction.

The CIS unit 43 may be mounted on the carriage 44 and may be located in proximate to the platen glass 20. The carriage 44 may be moved by a scanning mechanism (not shown) so as to scan an image on the platen glass 20 from underneath. When the scanner portion 2 is used as FBS, the carriage 44 may scan the lower place of the platen glass 20, such that the CIS unit 43 reads an image on the document placed on the platen glass 20. Alternatively, when the ADF 5 is used, the carriage 44 may move under the reading surface 19 and stand still where the CIS unit 43 reads an image of the document passing through the reading surface 19.

In this embodiment, the image reading unit 21 may be configured to scan along the platen glass 20 because the scanner portion 2 also may be used as the FBS. When the present invention comprises a sheet feeder used for image reading only by the ADF 5, the image reading unit 21 may be installed at a position facing the feed roller 38, which may eliminate the scanning mechanism. In addition, in this embodiment, the CIS unit 43 may be used in the image reading unit 21. However, a known image reading unit, for example, a charge coupled device (CCD) image sensor of a reduction optical system, may be used.

Figure 5:
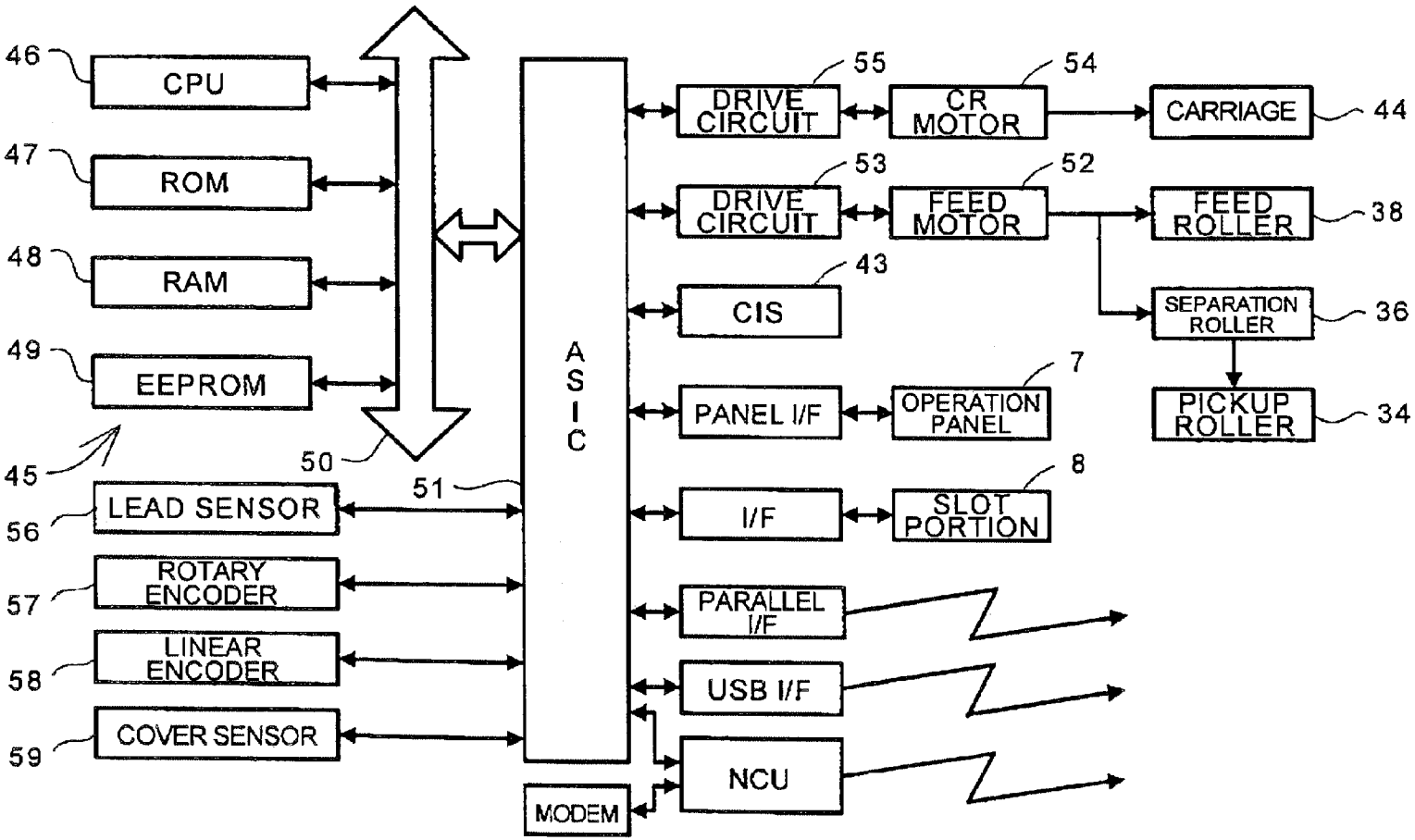
FIG. 5 is a block diagram of a controller.

FIG. 5 depicts a controller 45 of the complex machine 1. The controller 45 may control the operation of the complex machine 1 including not only the scanner portion 2 but also the printer portion 3. The controller 45 may comprise a microcomputer comprising a CPU 46, a ROM 47, a RAM 48, and an EEPROM (electrically erasable and programmable ROM) 49, and may be connected to an ASIC (Application Specific Integrated Circuit) 51 via a bus 50.

The ROM 47 may store various kinds of programs for controlling each operation of the complex machine 1. The RAM 48 may be used as a memory area or a work area to temporarily store data the CPU 46 uses to execute the programs.

The ASIC 51 with a command from the CPU 46, generate a phase excitation signal to energize the feed motor 52, give the signal to a drive circuit 53 of the feed motor 52, apply a drive signal to the feed motor 52 via the drive circuit 53, and control the rotation of the feed motor 52.

The drive circuit 53 may drive the feed motor 52 that is connected to the pickup roller 35, the separation roller 36, and the feed roller 38. The drive circuit 53 receives an output signal from the ASIC 51, and generates an electrical signal to rotate the feed motor 52. After receiving the electrical signal, the feed motor 52 rotates, and the rotation of the feed motor 52 is transmitted to the separation roller 36 and the feed roller 38, e.g., via a known drive mechanisms comprising gears and drive shafts. The rotation of the feed motor 52 to the pickup roller 34 may be transmitted from the separation roller 36 via the drive transmission mechanism.

Similarly, the ASIC 51 complies with a command from the CPU 46, generates a phase excitation signal to energize a carriage (CR) motor 54, gives the signal to a drive circuit 55 of the carriage motor 54, applies a drive signal to the carriage motor 54 via the drive circuit 55, and controls rotation of the carriage motor 54.

The drive circuit 55 may drive the carriage motor 54 that is connected to the carriage 44. The drive circuit 55 receives an output signal from the ASIC 51, and generates an electrical signal to rotate the carriage motor 54. Receiving the electrical signal, the carriage motor 54 rotates, the rotational force of the carriage motor 54 is transmitted to the carriage 44, e.g., via a known belt drive mechanism, and the carriage 44 is scanned.

The ASIC 51 may be connected to a lead sensor 56 for detecting a document in the feed path 26, rotary encoders 57 provided at the separation roller 36 and the feed roller 38 to detect the number of rotations of these rollers, a linear encoder 58 to detect a travel of the carriage 44, and a cover sensor 59 to detect whether the ADF cover 28 is open or closed.

The ASIC 51 also may be connected to the CIS unit 43 that performs image reading of a document being fed in the feed path 26, the operation panel 7 for indicating an operation of the complex machine 1, the slot portion 8 into which various compact memory cards are inserted, a parallel interface and a USB interface that exchange data with external equipment such as a personal computer via a parallel or USB cable, a network control unit (NCU) for realizing a facsimile function, and a modem.

Figure 6:
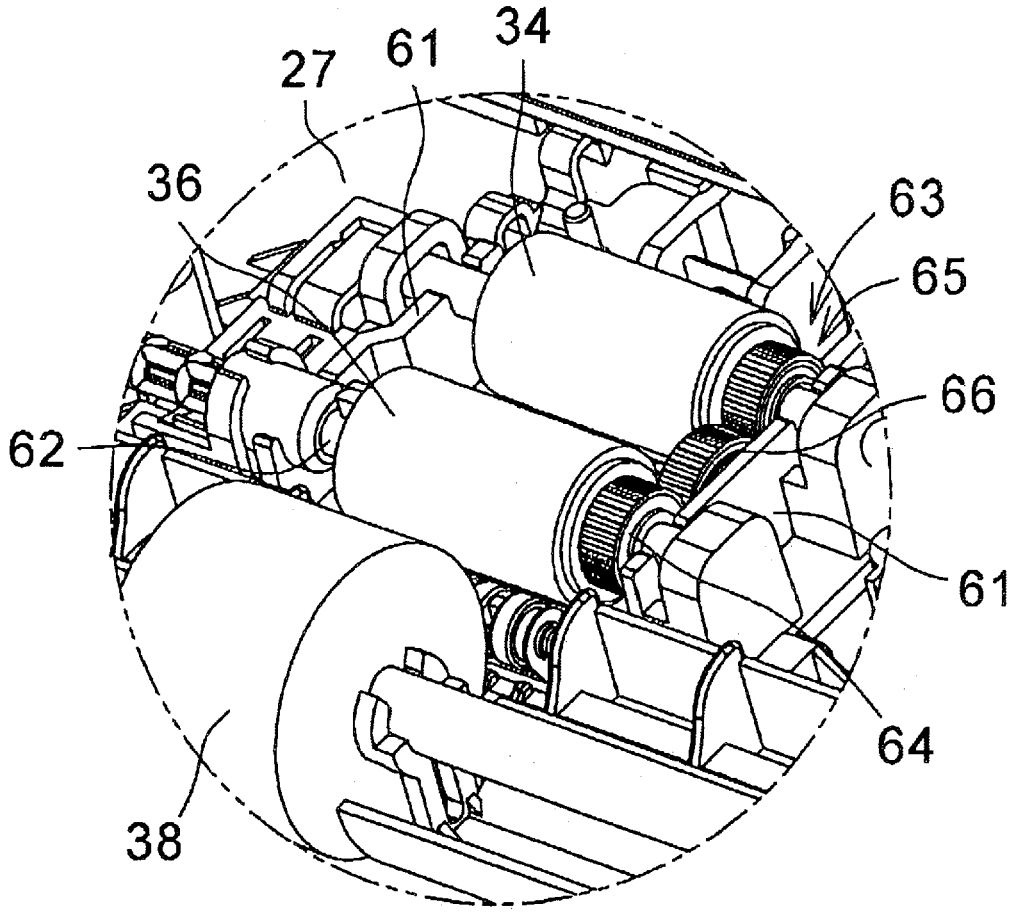
FIG. 6 is an enlarged, perspective view of a drive transmission mechanism.

FIG. 6 depicts an embodiment in which the guide plate 30 is removed. In this embodiment, the pickup roller 34 and the separation roller 36 may be supported by a shaft supporting portion 61 formed in the DF main body 27 and spaced in the sheet feeding direction under the guide plate 30 (not shown in FIG. 6). A shaft 62 of the separation roller 36 may be driven by the feed motor 52. Disposed on one end of the shaft 62 may be a drive transmission mechanism 63 that transmits a drive of the feed motor 52 from the separation roller 36 to the pickup roller 34.

Figure 7:
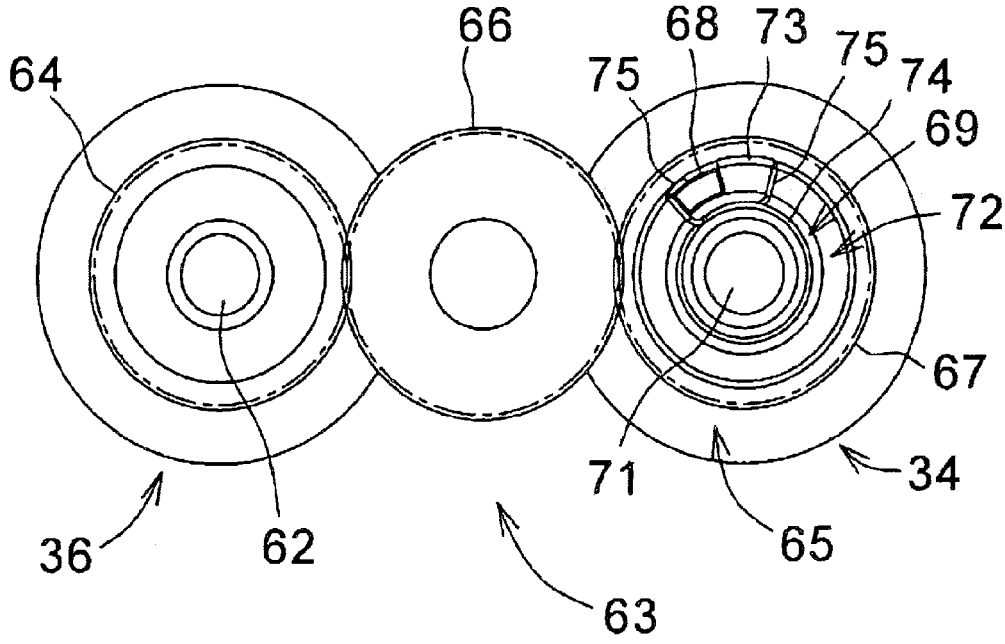
FIG. 7 is a schematic view of the drive transmission mechanism according to the first embodiment of the present invention.

As shown in FIGS. 6 and 7, the drive transmission mechanism 63 may comprise a gear 64 fitted around the shaft 62 of the separation roller 36, the clutch 65 provided at one end of the pickup roller 34, and a drive transmission gear 66 that transmits drive power from the gear 64 to the clutch 65. The gear 64 may comprise a spur gear having teeth that are parallel to its axis on its circumference, and may have a D-shape at an engaged portion with the shaft 62 to rotate integrally with the shaft 62.

Figure 8:
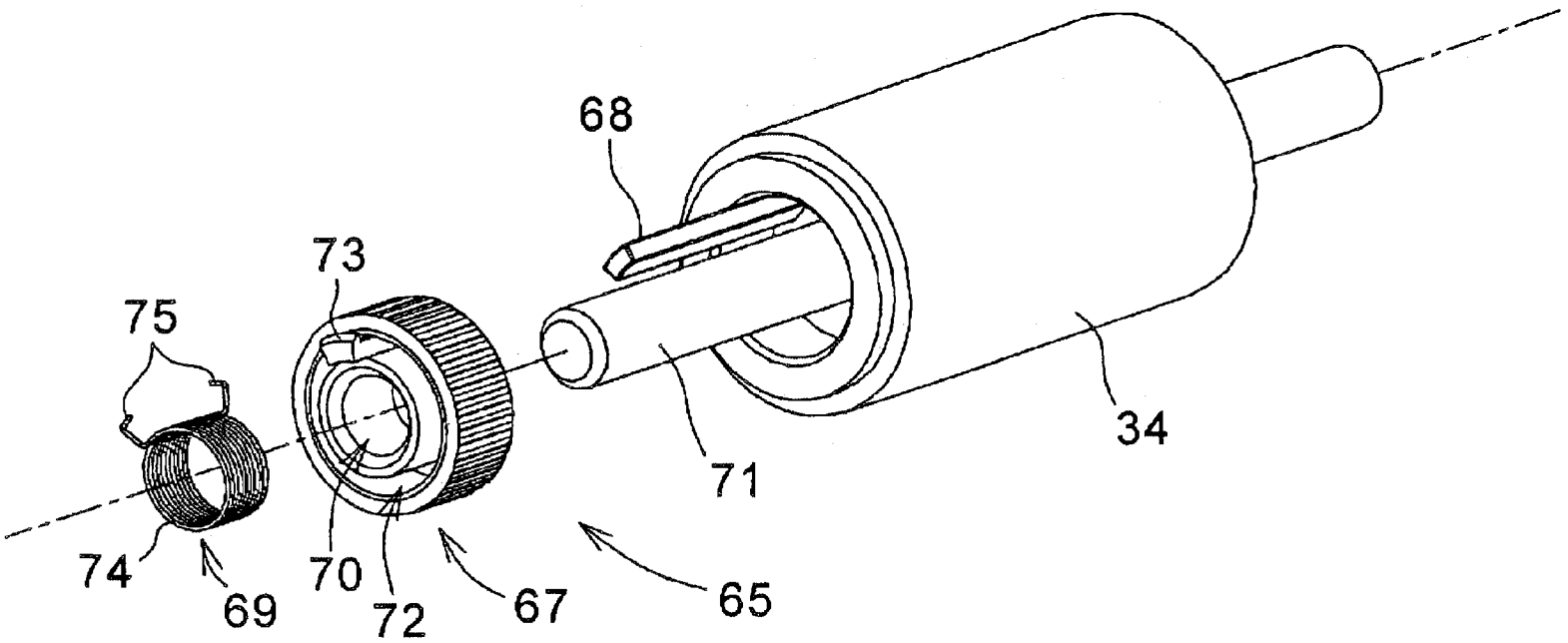
FIG. 8 is an exploded, perspective view of a clutch according to the first embodiment of the present invention.
Figure 9:
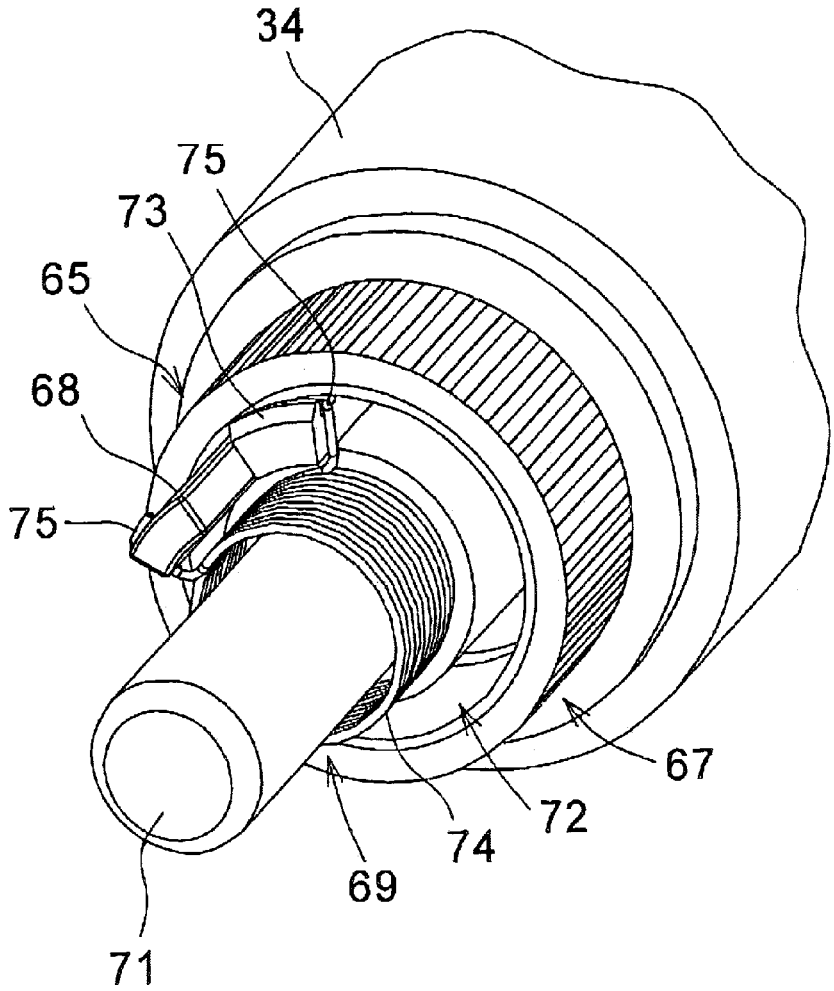
FIG. 9 is an enlarged, perspective view of the clutch according to the first embodiment of the invention.

The clutch 65 may comprise a clutch gear 67 and an engaging member 68 as shown in FIGS. 8 and 9. The clutch 65 also may comprise a torsion coil spring 69 (functioning as an urging member) that urges the clutch gear 67 and the engaging member 68.

The clutch gear 67 may comprise a spur gear having teeth that are parallel to its axis on its circumference. The clutch gear 67 may be rotatable with respect to a shaft 71 of the pickup roller 34 as the shaft 71 is inserted into a shaft hole 70 opened in the axial direction. An engagement groove 72 may be formed in a circular arc around the shaft hole 70 so as to extend there through in the axial direction. The engagement groove 72 may be provided into which the engaging member 68 may be inserted, and may be shaped in the circular arc because an engagement portion 73 is formed therein.

The engagement portion 73 may contact the engaging member 68 to transmit drive power to the pickup roller 34 via the engaging member 68. The engagement portion 73 comprises both end surfaces of the circular arc defining the engagement groove 72. The engagement portion 73 may protrude in the form of a hook into the same axial direction as the engaging member 68, and arm portions 75 of the torsion coil spring 69 may be disposed on the hook portion.

The engaging member 68 may be a rod-like member that protrudes in the axial direction from one end of the pickup roller 34 at which the clutch gear 67 is fitted. The engaging member 68 may protrude from a position corresponding to the engagement groove 72 of the clutch gear 67, and may be long enough to protrude from the clutch gar 67 through the engagement groove 72.

As shown in FIG. 9, the clutch gear 67 may be fitted around the shaft 71 of the pickup roller 34, and the engaging member 68 may be inserted into the engagement groove 72, such that the pickup roller 34 and the clutch gear 67 are assembled. When the clutch gear 67 rotates counterclockwise in a condition in which the engaging member 68 is in contact with a counterclockwise position of the engagement portion 73 of the clutch gear 67, the engagement portion 73 presses the engaging member 68 counterclockwise. Thus, the clutch gear 67 and the pickup roller 34 rotate counterclockwise.

On the contrary, when the pickup roller 34 rotates counterclockwise with the clutch gear 67 standing still, the engaging member 68 slides in the engagement groove 72, and the clutch gear 67 remains standing still without rotation. When the pickup roller 34 rotates about one turn, the engaging member 68 reaches a clockwise position of the engagement portion 73 and contacts the engagement portion 73. To further rotate the pickup roller 34 counterclockwise from this state, the engaging member 68 rotates the pickup roller 34 and the clutch gear 67 counterclockwise while pressing the engagement portion 73 counterclockwise.

In this manner, the clutch 65 allows the pickup roller 34 to rotate idle, e.g., under low load conditions, for about one turn in which the engaging member 68 slides in the engagement groove 72 of the clutch gear 67.

The torsion coil spring 69 may be disposed in the assembled pickup roller 34 and the clutch gear 67. As shown in FIGS. 8 and 9, the torsion coil spring 69 may comprise a coil portion 74 and the arm portions 75. The coil portion 74 may be loosely fitted around the shaft 71 of the pickup roller 34, and the arm portions 75 may be hooked on to the engaging member 68 and the engagement portion 73, respectively. The pickup roller 34 and the clutch gear 67 may be elastically urged by the torsion coil spring 69, and the engaging member 68 may contact the counterclockwise position of the engagement portion 73, as shown in FIG. 9, unless the pickup roller 34 and the clutch gear 67 are subject to an external force against the elastic urging force.

As shown in FIGS. 6 and 7, the drive transmission gear 66 may be disposed between the gear 64 and the clutch gear 67. The drive transmission gear 66 may comprise a spur gear having teeth that are parallel to its axis around its circumference, and may engage the gear 64 and the clutch gear 67. With this structure, a drive power from the gear 64 to the clutch 65 may be transmitted.

When image reading is performed by the scanner portion 2 using the ADF 5, as shown in FIG. 1, the document holding cover 6 should be in a closed position, and a document to be read should be placed in the input tray 22. The number of documents may be one or more documents. For example, when the number of documents of a predetermined size are read, the documents are aligned and are held by the input tray 22, such that one end thereof is inserted into the pickup-side chute portion 29.

The documents inserted into the pickup-side chute portion 29 contact the pickup roller 34 and the pickup-side nip member 35. As the pickup-side nip member 35 is formed with the cutout portion 42, as shown in FIGS. 2 and 3, the pickup-side nip member 35 may be maintained out of contact with the pickup roller 34. Thus, without any document inserted, external forces are not applied to the pickup roller 34, and the pickup roller 34 is elastically urged by the torsion coil spring 69, as shown in FIGS. 7 and 9, such that the engaging member 68 contacts the counterclockwise position of the engagement portion 73. In other words, the engaging member 68 of the pickup roller 34 is in contact with an end of the engagement groove 72 with respect to a direction opposite to the sheet feeding direction. The engagement groove 72 of the clutch 65 may define a range in which the pickup roller 34 may be rotated in an idle condition. Thus, the pickup roller 34 may be configured to rotate idle for one turn in the sheet feeding direction.

When the documents contact the pickup roller 34 and the pickup-side nip member 35, the documents cause the pickup roller 34 to rotate idle in the sheet feeding direction against the elastic urging force of the torsion coil spring 69, and cause the pickup-side nip member 35 to retract against the elastic urging force of the spring member, and then the documents are inserted further inside. At this time, the elastic urging force of the torsion coil spring 69, the elastic urging force of the spring member that urges the pickup-side nip member 35 are applied to the documents as resistance to the insertion. However, the user may insert the documents further inside with little resistance by adjusting the elastic urging forces of the torsion coil spring 69 and the spring member, respectively. Thus, the position when the documents contact the pickup roller 34 and the pickup-side nip member 35 is not misidentified as an insertion limit position.

The documents, which are inserted further inside the pickup-side chute portion 29 while causing the pickup roller 34 to rotate idle, contact the separation roller 36 and the separation nip member 37. The shaft 62 of the separation roller 36 is subjected to a load due to the drive transmission mechanism from the feed motor 52. Thus, to insert the documents further inside by the separation roller 36, the separation roller 36 should be rotated against the load or the documents should slide on the roller surface of the separation roller 36. Due to the load or sliding friction, the user feels resistance when inserting the documents into the pickup-side chute portion 29, and readily may determine that the document insertion is complete. By placing the documents on the input tray 22 with the leading ends of the documents inserted into the pickup-side chute portion 29, the document setting is complete.

The user instructs the complex machine 1 to start image reading of the documents from the operation panel 7. The operation panel 7 comprises, for example, a start button. With a press of the start button, the start of image reading can be directed to the complex machine 1. Upon the direction, the controller 45 of the complex machine 1 activates the feed motor 52 via the drive circuit 53. In response to this, rotation of the feed motor 52 is transmitted to the separation roller 36. As a result, the separation roller 36 starts rotating, but the documents are not fed and instead remain stationary at the document set position because their leading ends are not nipped by the separation roller 36 and the separation nip member 37.

Figure 10:
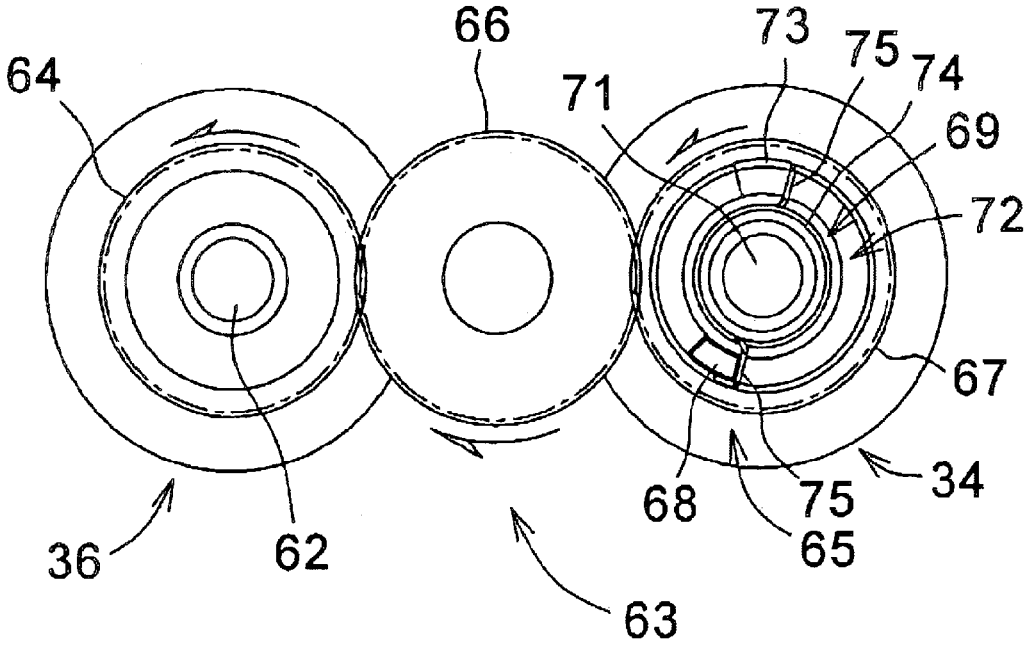
FIG. 10 is a schematic view of the drive transmission mechanism in a state where an engaging member is positioned ahead of an engagement portion according to the first embodiment of the present invention.

As described above, as the pickup roller 34 is brought to rotate idle in the sheet feeding direction during document insertion, the engaging member 68 is advanced with respect to the engagement portion 73 in the sheet feeding direction as shown in FIG. 10. In this condition, when the rotational force is inputted into the shaft 62 of the separation roller 36, the gear 64 rotates in the sheet feeding direction, e.g., counterclockwise, along with the separation roller 36. In response to the rotation, the drive transmission gear 66 in engagement the gear 64 rotates in the sheet feeding direction, and the clutch gear 67 in engagement with the drive transmission gear 66 also rotates in the sheet feeding direction.

As shown in FIG. 10, the engagement portion 73 of the clutch gear 67 is separated from the engaging member 68. Thus, even if the clutch gear 67 starts to rotate, the rotation is not transmitted to the engaging member 68 at once, and the clutch gear 67 is rotated idle at the shaft 71 of the pickup roller 34. Then, when the clutch gear 67 rotates until the engagement portion 73 contacts the engaging member 68, the engagement portion 73 presses the engaging member 68 counterclockwise, and rotation transmission is started. In response to this, the pickup roller 34 rotates in the sheet feeding direction.

When the pickup roller 34 rotates, the documents being pressed against the pickup roller 34 by the urging force of the pickup-side nip member 35 are fed in the sheet feeding direction. Specifically, the leading ends of the documents placed in the input tray 22 are inserted inside from the place where the pickup roller 34 and the pickup-side nip member 35 are disposed. Although the pickup-side nip member 35 does not contact the pickup roller 34, it contacts the guide plate 30 at its both sides with respect to the axial direction of the pickup roller 34, as shown in FIGS. 2 and 3. Thus, the documents are urged toward the guide plate 30 where the pickup roller 34 is provided, at both sides of the pickup roller 34 with its axial direction, and are brought in contact with the roller surface of the pickup roller 34. Thus, the rotation force of the pickup roller 34 is transmitted to the documents.

The documents are integrally urged toward the pickup roller 34 by the pickup-side nip member 35. However, only a lowermost document contacts the roller surface of the pickup roller 34, such that only the lowermost document receives the rotation force of the pickup roller 34 and is fed in the sheet feeding direction. Then, the leading end of the document goes in between the separation roller 36 and the separation nip member 37 and then is nipped therebetween. The document is pressed against the roller surface of the separation roller 36 by the separation nip member 37, receives the rotation force of the separation roller 36, and is further fed in the sheet feeding direction. When the lowermost document is fed by the pickup roller 34, it may be fed together with a document immediately placed thereon due to static electricity. However, even if two or more documents go in between the separation roller 36 and the separation nip member 37, it is only the lowermost document that directly receives the rotation force of the separation roller 36. Thus, only the lowermost document is separated from the documents and fed into the feed path 26.

The document being fed is guided to the feed path 26 and is fed downstream toward the reading surface 19. That is, the document is nipped between the feed roller 38 and the pinch roller 39 disposed immediately downstream of the separation roller 36, and is subject to the rotation of the feed roller 38, and then is fed to the reading surface 19. In the feed path 26 until the leading end of the document reaches the reading surface 19, the leading end of the document is detected by the lead sensor 56, and it is determined that the leading end of the document reaches the reading surface 19 by the amount of rotation of the feed motor 52 that transmits the rotation to the feed roller 38. When the leading end of the document reaches the reading surface 19, the CIS unit 43 starts to read image on the document passing through the reading surface 19.

The document is further fed while its image is being read by the CIS unit 43. The document is subject to the rotation of the feed roller 38 in a condition that the leading end of the document is nipped between the feed roller 38 and the pinch roller 39 disposed immediately downstream of the reading surface 19, and the trailing end of the document is nipped between the feed roller 38 and the pinch roller 39 disposed immediately upstream of the reading surface 19. Moreover, the document is fed in a U-turn so that the document is inverted along the curved portion 32. During this period, the CIS unit 43 continues to read the image of the document passing through the reading surface 19. The lead sensor 56 detects the trailing end of the document, and it is determined that the trailing end of the document reaches the reading surface 19 by the amount of rotation of the feed motor 52 that transmits the rotation to the feed roller 38. When the trailing end of the document passes through the reading surface 19, image reading by the CIS unit 43 is complete, and the document is ejected from the ejection chute portion 33 to the output tray 23.

When all of the documents placed on the input tray 22 are completely fed and the last document passes through the pickup roller 34, the pickup roller 34 is urged by the torsion coil spring 69 and rotates in the direction opposite to the sheet feeding direction, e,g., clockwise. For example, when a circumferential velocity of the feed roller 38 is greater than that of the pickup roller 34, the pickup roller 34 may rotate along with the document being fed by the rotation force of the feed roller 38, and the engaging member 68 may rotate in a condition where it is in a position where it advances more than the engagement portion 73, in other words, in a position at a distance from the engagement portion 73 in the counterclockwise direction.

From such a state, when all of the documents placed on the input tray 22 are completely fed and the last document passes through the pickup roller 34, the pickup roller 34 is urged by the torsion coil spring 69 and rotates in the direction opposite to the sheet feeding direction, e.g., counterclockwise. As described above, the pickup-side nip member 35 is maintained out of contact with the pickup roller 34 even if there is no document on the input tray 22, and external force against the urging force of the torsion coil spring 69 is not generates in the pickup roller 34. Thus, the pickup roller 34 may rotate idle within a range of rotation that the clutch 65 allows.

The engaging member 68 rotates clockwise along with the rotation of the pickup roller 34, and the engaging member 68 stops rotating when it contacts the engagement portion 73 of the clutch gear 67 as shown in FIG. 7. With this structure, the engaging member 68 returns to the end of the engagement groove 72 of the clutch 65 with respect to the direction opposite to the sheet feeding direction. Thus, when documents are set again in the input tray 22, the pickup roller 34 is configured to rotate idle for about one turn in the sheet feeding direction, e.g., counterclockwise. With this structure, the document may be set on the input tray 22, such that one end of the document is inserted into the pickup-side chute portion 29 until it contacts the separation roller 36 and the separation nip member 37.

When documents are set in the input tray 22 as described above, the pickup roller 34 enters a state in which the pickup roller 34 is rotated idle in the sheet feeding direction from the end of the engagement groove 72 with respect to the direction opposite to the sheet feeding direction, as shown in FIG. 10.

Thus, the pickup roller 34 may rotate idle in the opposite direction of the sheet feeding direction, e.g., when the user sets a document on the input tray 22 but immediately removes it from the pickup-side chute portion 29 to add another document. In this case, the pickup roller 34 may rotate idle in the sheet feeding direction along with the removal of the document, such that the user may remove the document from the pickup-side chute portion 29 with little or no resistance.

As shown in FIGS. 3 and 4, when the ADF cover 28 is opened, e.g., for clearing a paper jam in the feed path 26 or to conduct maintenance inside the ADF 5, the user may touch or contact the pickup roller 34, which may cause the pickup roller 34 to rotate. In this case, the pickup roller 34 receives the elastic urging force of the torsion coil spring 69 and returns to the end of the groove 72 of the clutch 65 with respect to the direction opposite to the sheet feeding direction. Thus, when documents are set in the input tray 22 after the ADF cover 28 is held in the closed position, the pickup roller 34 is configured to rotate idle for about one turn in the sheet feeding direction, e.g., counterclockwise. With this structure, it is possible to set documents in the input tray 22 by inserting them into the pickup-side chute portion 29 until the leading ends of the document contact the separation roller 36 and the separation nip member 37.

When the leading end of the document set on the input tray 22 is inserted into the pickup-side chute portion 29, the pickup roller 34, which contacts the leading end of the document, may rotate idle for about one turn. When the leading end of the document passes the position where the pickup roller 34 is disposed, the user may insert the document by the insertion limit position with little or no resistance. Thus, the document set in the input tray 22 may be fed in the sheet feeding direction upon the rotation of the pickup roller 34, such that the document is supplied in the feed path 26 with reliability. In addition, it is possible to pull out the document set in the input tray 22 without or substantially without resistance, and the document will not tear at that time. If the ADF cover 28 is opened, e.g., for clearing of a paper jam or for maintenance, and the pickup roller 34 is accidentally caused to rotate idle, the torsion coil spring 69 causes the pickup roller 34 to return to the end of the engagement groove 72 of the clutch 65 with respect to the direction opposite to the sheet feeding direction. Thus, document setting thereafter in the input tray 22 may be done with reliability.

In a second embodiment of the present invention, the pickup-side nip member 35 of the first embodiment is changed, however, the other components of the second embodiment are the same as those in the first embodiment. Therefore, only the changes to the pickup-side nip member 35 are described with respect to the second embodiment.

Figure 11:
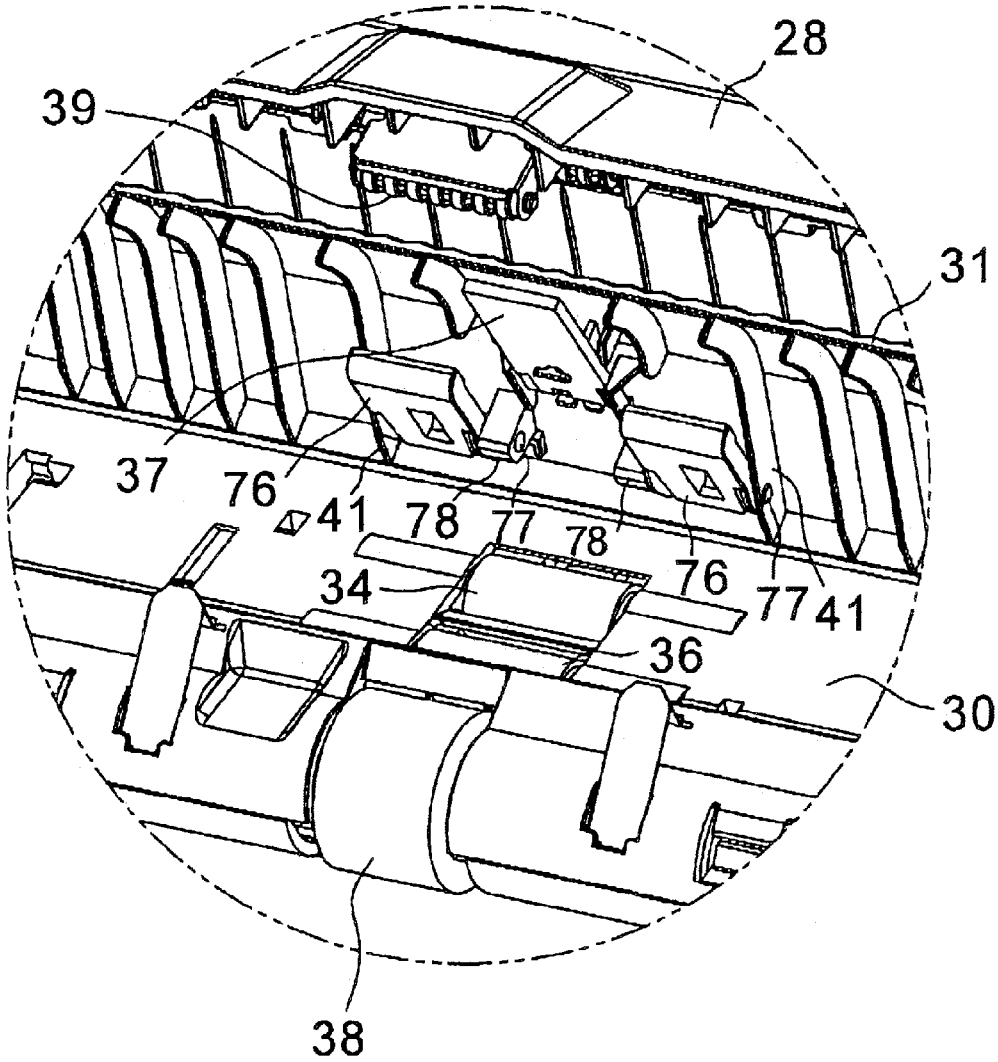
FIG. 11 is an enlarged, perspective view showing parts adjacent to a pickup-side nip member according to a second embodiment of the present invention.

As shown in FIG. 11, a pair of pickup-side nip members 76 may be disposed at the partition plate 31 to face both ends of the pickup roller 34, may be pivotable in directions to contact and to separate from the guide plate 30. Each of the pickup-side nip members 76 may comprise a pad having a predetermined width, and a rotating shaft 77 on an upstream side with respect to the sheet feeding direction. Each rotating shaft 77 may be supported by its respective rib 41 and shaft support portion 78 provided on the underside of the partition plate 31, and the pair of the pickup-side nip members 76 may be pivotally moved, such that a downstream-side end portion thereof with respect to the sheet feeding direction may contact the top surface of the guide plate 30. Each of the pickup-side nip members 76 may be elastically urged downward by a spring member (not shown) and may be constantly maintained in contact with the guide plate 30 without a document nipped.

Alternatively, the pickup-side nip members 76 merely may be disposed adjacent or close to the guide plate 30 so long as they are placed below the uppermost position of the roller surface of the pickup roller 34. In addition, the pickup-side nip members 76 may comprise a roller instead of a pad.

In general, the pickup-side nip members 76 do not contact the pickup roller 34 because they are disposed at both ends of the pickup roller 34 with respect to its axial direction. With this arrangement, the pickup roller 34 may rotate idle with the pickup-side nip members 76 in contact with the top surface of the guide plate 30. Thus, as shown in the first embodiment, an external force is not applied to the pickup roller 34 when there is no document in the pickup-side chute portion 29, and the torsion coil spring 22 allows the pickup roller 34 to return to the end of the engagement groove 72 of the clutch 65 with respect to the direction opposite to the sheet feeding direction. Thus, document setting in the input tray 22 can be done reliably. In addition, when the documents, which are set in the input tray 22, are supplied, they can be brought in contact with the roller surface of the pickup roller 34 by the pickup-side nip members 76.

In a third embodiment of the present invention, the pickup roller 34 and the pickup-side nip member 35 of the first embodiment are changed, however, the other components of the third embodiment are the same as those in the first embodiment. Therefore, only the changes to the pickup roller 34 and the pickup-side nip member 35 are described with respect to the third embodiment.

Figure 12:
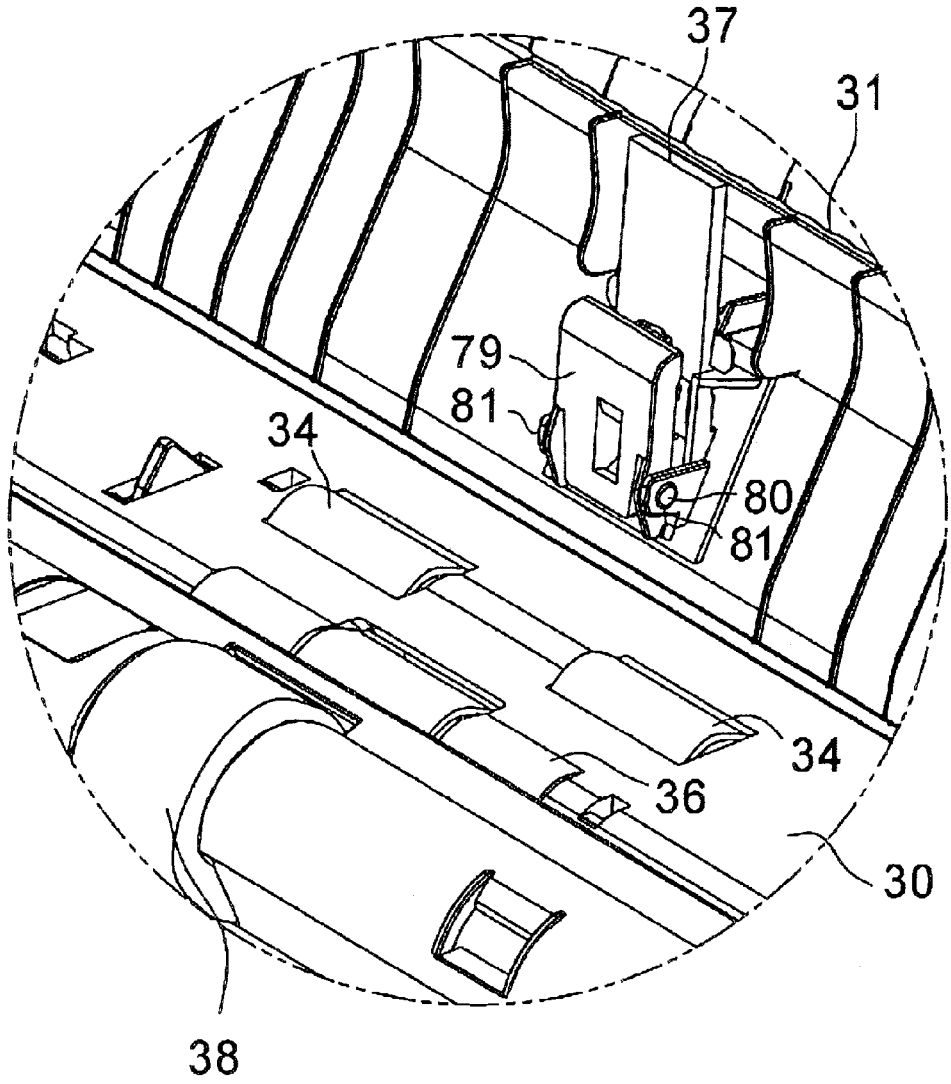
FIG. 12 is an enlarged, perspective view showing parts adjacent to a pickup-side nip member according to a third embodiment of the present invention.

In this embodiment, the pickup rollers 34 may be spaced on the same axis line as shown in FIG. 12. The pickup rollers 34 may be provided on the same shaft, and may simultaneously rotate at the same circumferential velocity when a rotation force of the separation roller 36 is transmitted to the shaft. The drive transmission mechanism 63, shown in the first embodiment, may transmits power to one of the pickup rollers 34 allowing for idling for about one turn. Thus, if one pickup roller 34, to which the power is transmitted, is able to rotate idle, another pickup roller 34 also is able to rotate idle. In addition, if power is transmitted to one pickup roller 34 to rotate, another pickup roller 34 also rotates.

As shown in FIG. 12, a pickup-side nip member 79 may be provided in a position facing in between the pair of pickup rollers 34 to pivotally move in directions to contact or to separate from the guide plate 30. The pickup-side nip member 79 may comprise a pad having a predetermined width, and may be formed with pivots 80 at both sides on the upstream side with respect to the sheet feeding direction. As the pivots 80 are supported by shaft support portions 81 formed on the underside of the partition plate 30, the pickup-side nip member 79 may be pivotally moved, such that a downstream-side end portion thereof with respect to the sheet feeding direction may contact the top surface of the guide plate 30. The pickup-side nip member 79 may be elastically urged downward by a spring member, not shown, and always maintained in contact with the guide plate 30 without any document nipped.

In this embodiment, the pickup-side nip member 79 may contact with the guide plate 30. Alternatively, the pickup-side nip member 79 may be disposed adjacent to or close to the guide plate 30 if it is located below the uppermost position of the roller surface of the pickup roller 34. Moreover, the pickup-side nip member 79 may comprise a roller instead of a pad.

Generally, the pickup-side nip member 79 does not contact pickup rollers 34 because it is disposed between the pickup rollers 34. This arrangement causes the pickup rollers 34 to rotate idle with the pickup-side nip member 79 in contact with the top surface of the guide plate 30. Thus, as shown in the first embodiment, an external force is not applied to the pickup rollers 34 when there is no document in the pickup-side chute portion 29, and the torsion coil spring 22 causes the pickup roller 34 to return to the end of the engagement groove 72 of the clutch 65 with respect to the direction opposite to the sheet feeding direction. As a result, document setting in the input tray 22 may be done reliably. In addition, when documents, which are set in the input tray 22, are supplied, they may contact the roller surface of the pickup roller 34 by the pickup-side nip member 79.

In a fourth embodiment of the present invention, the pickup-side nip member 35 of the first embodiment is changed, however, other components of the fourth embodiment are the same as those in the first embodiment. Therefore, only the changes to the pickup-side member 35 are described with respect to the fourth embodiment.

Figure 13:
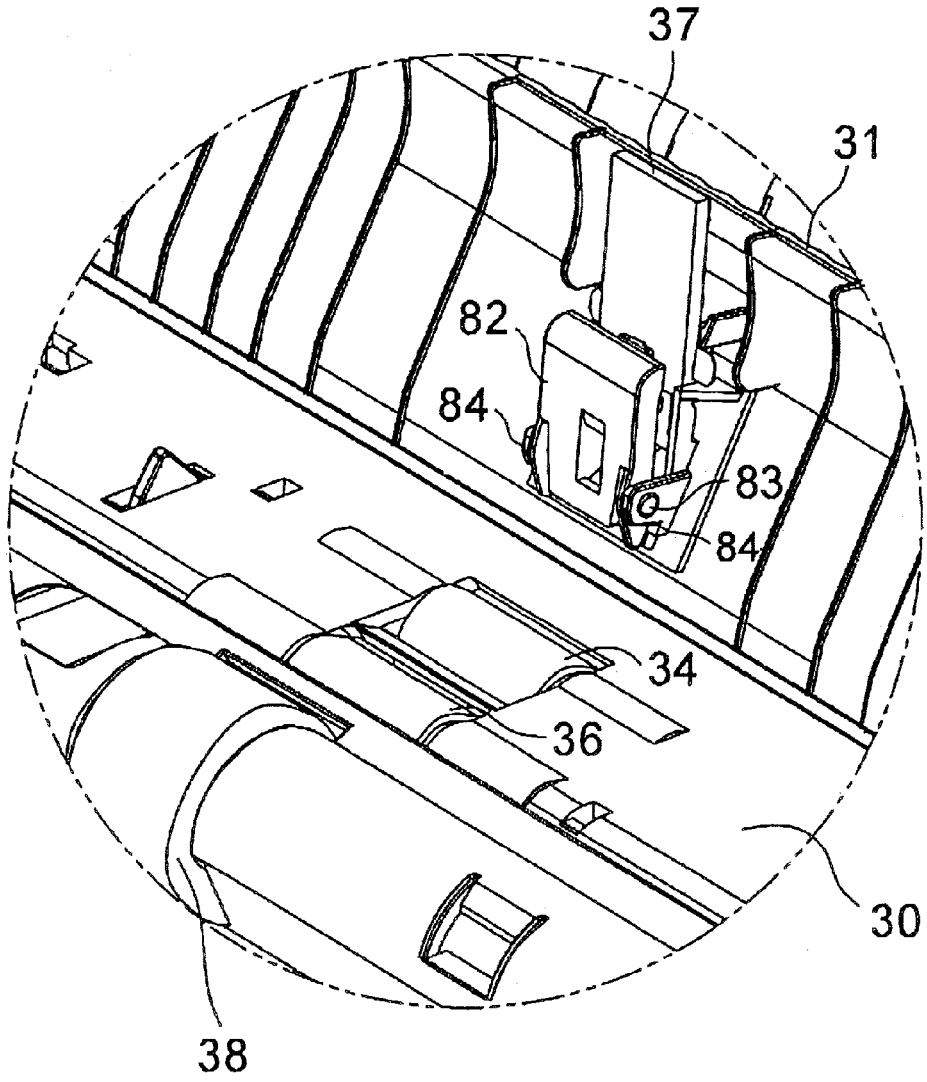
FIG. 13 is an enlarged, perspective view showing parts adjacent to a pickup-side nip member according to a fourth embodiment of the present invention.
Figure 14:
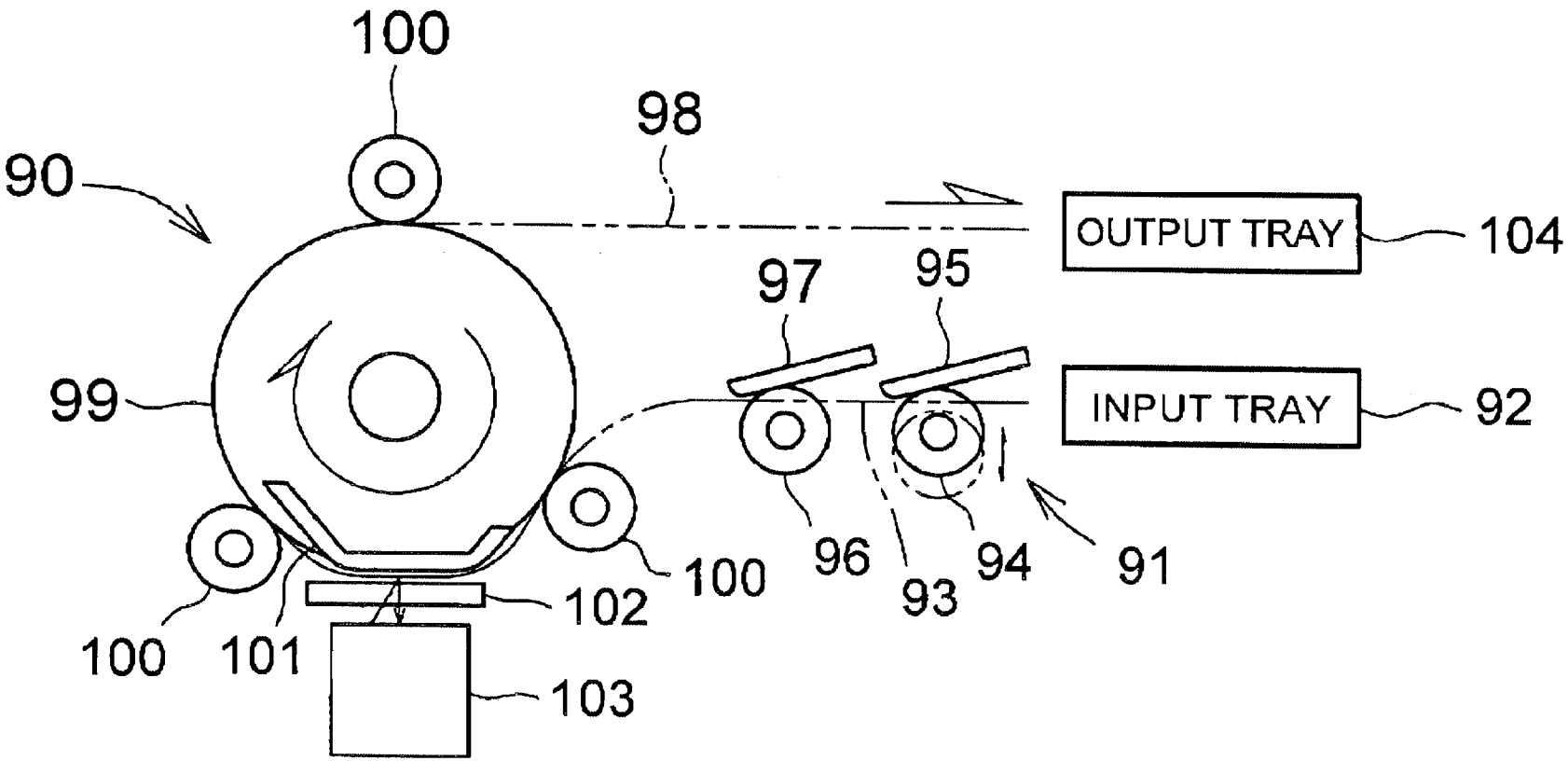
FIG. 14 is a schematic view of a known sheet feeder.

As shown in FIG. 13, a pickup-side nip member 82 may be provided at the partition plate 31 facing the pickup roller 34 to pivotally move in directions to contact and to separate from the pickup roller 34. The pickup-side nip member 82 may comprise a pad having a width that is narrower than the width of the pickup roller 34, and is formed with pivots 83 at both sides on the upstream side with respect to the sheet feeding direction. The pivots 83 may be supported by shaft support portions 84 formed on the underside of the partition plate 31, such that the pickup-side nip member 82 is pivotally moved so that a downstream-side end portion thereof with respect to the sheet feeding direction may contact the top surface of the guide plate 30. The pickup-side nip member 82 may be elastically urged downward by a spring member (not shown), and may be maintained in contact with the pickup roller 34 without a document nipped.

The pickup-side nip member 82 may comprise a roller instead of a pad.

As the pickup-side nip member 82 presses in contact with the roller surface of the pickup roller 34, when documents set in the input tray 22 are supplied, the pickup-side nip member 82 may cause the documents to make contact with the roller surface of the pickup roller 34. In addition, when the ADF cover 28 is opened, e.g., for clearing a paper jam or for maintenance, the user may touch the pickup roller 34, which may causes the pickup roller 34 to rotate idle. In this case, the torsion coil spring 69 allows the pickup roller 34 to return to the end of the engagement groove 72 of the clutch 65 with respect to the direction opposite to the sheet feeding direction.

In this embodiment, as the pickup-side nip member 82 presses in contact with the pickup roller 34 without a document in the pickup-side chute portion 29, the pickup-side nip member 82 may hold the pickup roller 34 from idling due to the torsion coil spring 69. Thus, for example, when the ADF 5 feeds a document, if the circumferential velocity of the feed roller 38 is greater than that of the pickup roller 34, the pickup roller 34 may be held in a position except for the end of the engagement groove 72 of the clutch 65 after documents are fed inside. To prevent this, after the documents in the input tray 22 are completely fed inside, the feed motor 52 may be further rotated to move the pickup roller 34 to the end of the engagement groove 72 of the clutch 65 with respect to the direction opposite to the sheet feeding direction.

In a fifth embodiment of the present invention, a gear 173 that moves along with an opening/closing motion of the ADF cover 28 is used as a return mechanism instead of the torsion coil spring 69 described in the above embodiments. Therefore, only gear 173 is described with respect to the fifth embodiment.

The following description is of a motion transmission mechanism that links a closing motion of the ADF cover 28 and an idle rotation of the pickup roller 34 according to the fifth embodiment of the present invention.

Figure 19:
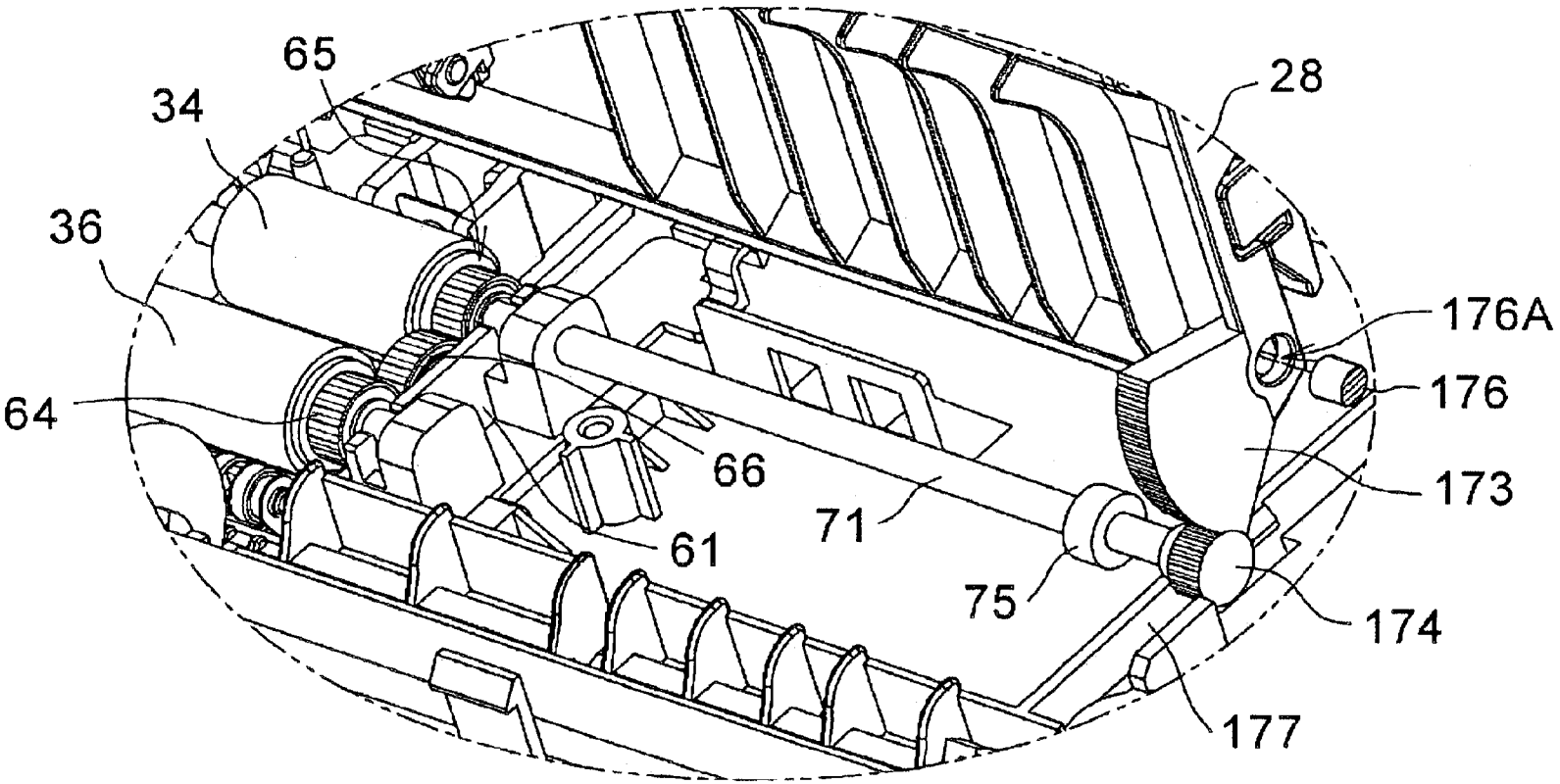
FIG. 19 is an enlarged, perspective view of a motion transmission mechanism according to the fifth embodiment of the present invention.

In this embodiment, the motion transmission mechanism rotates the pickup roller 34 to the end of the engagement groove 72 of the clutch 65 with respect to the direction opposite to the sheet feeding direction based on the closing motion of the ADF cover 28. As shown in FIG. 19, the motion transmission mechanism may comprise a gear 173 (a first motion transmission gear) provided at the ADF cover 28, a gear 174 (a second motion transmission gear) provided around the shaft 71 of the pickup roller 34, and a torque limiter 175 provided around the shaft 71. FIG. 19 shows a condition in which guide plate 30 is removed.

The gear 173, which may have the shape of a fan, may be coaxially formed with a bearing 176A of the ADF cover 28, and may comprise a spur gear having teeth that are parallel to its axis on its circumference. As shown in FIG. 19, a shaft 176 may be formed on the ADF main body 27 so as to horizontally protrude inward. The bearing 176A may be formed on each side of the ADF cover 28 with respect to its width in a position corresponding to the shaft 176. As the bearing 176A supports the shaft 176, the ADF cover 28 may be rotatable with respect to the ADF main body 27. The gear 173 may be integrally formed with the bearing 176A provided at one side of the ADF cover 28 so as to protrude substantially downward from the ADF cover 28. The gear 173 rotates around the shaft 176 along with the opening/closing motion of the ADF cover 28.

The gear 174 may be fixed at one end of the shaft 71 of the pickup roller 34. In particular, the shaft 71 extends from the pickup roller 34 toward a side where the gear 173 is provided, and is rotatably supported by a shaft support portion 177 which is formed near the gear 173 in the ADF main body 27. The gear 173 and the gear 174 may be provided at the end of the shaft 71. The gear 174 may comprise a spur gear having teeth that are parallel to its axis on its circumference, and may be formed in a D-shape at an engaged portion with the shaft 71 to rotate integrally with the shaft 71.

The torque limiter 175 may be provided around the shaft 71 and placed between the pickup roller 34 and the gear 174. The torque limiter 175 transmits rotation of the shaft 71 between the pickup roller 34 and the gear 174, and interrupts the transmission when a load exceeds a predetermined load. Any known friction clutch may be used as the torque limiter 175. For example, the torque limiter 175 may comprise two disks placed opposite to each other and brought close to each other by a spring. By appropriately adjusting the coefficient of friction of the disks and spring force, the disks may integrally rotate by frictional forces to transmit rotation until a specified torque is reached, and the disks may slip to interrupt the rotation transmission when a torque exceeding the predetermined value is applied.

Figure 20:
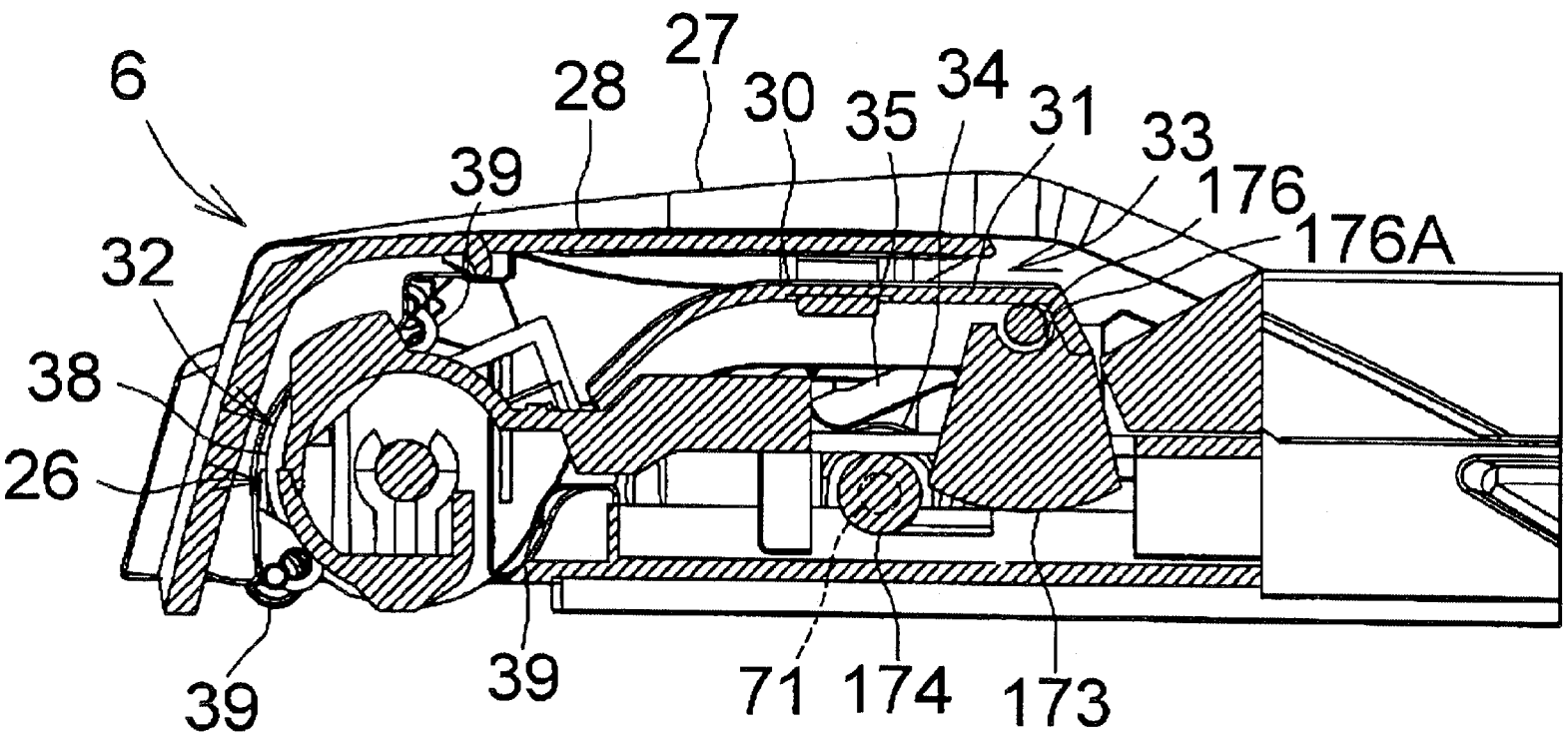
FIG. 20 is a sectional view of the ADF when the ADF cover is closed, taken along the line B-B of FIG. 1, according to the fifth embodiment of the present invention.
Figure 21:
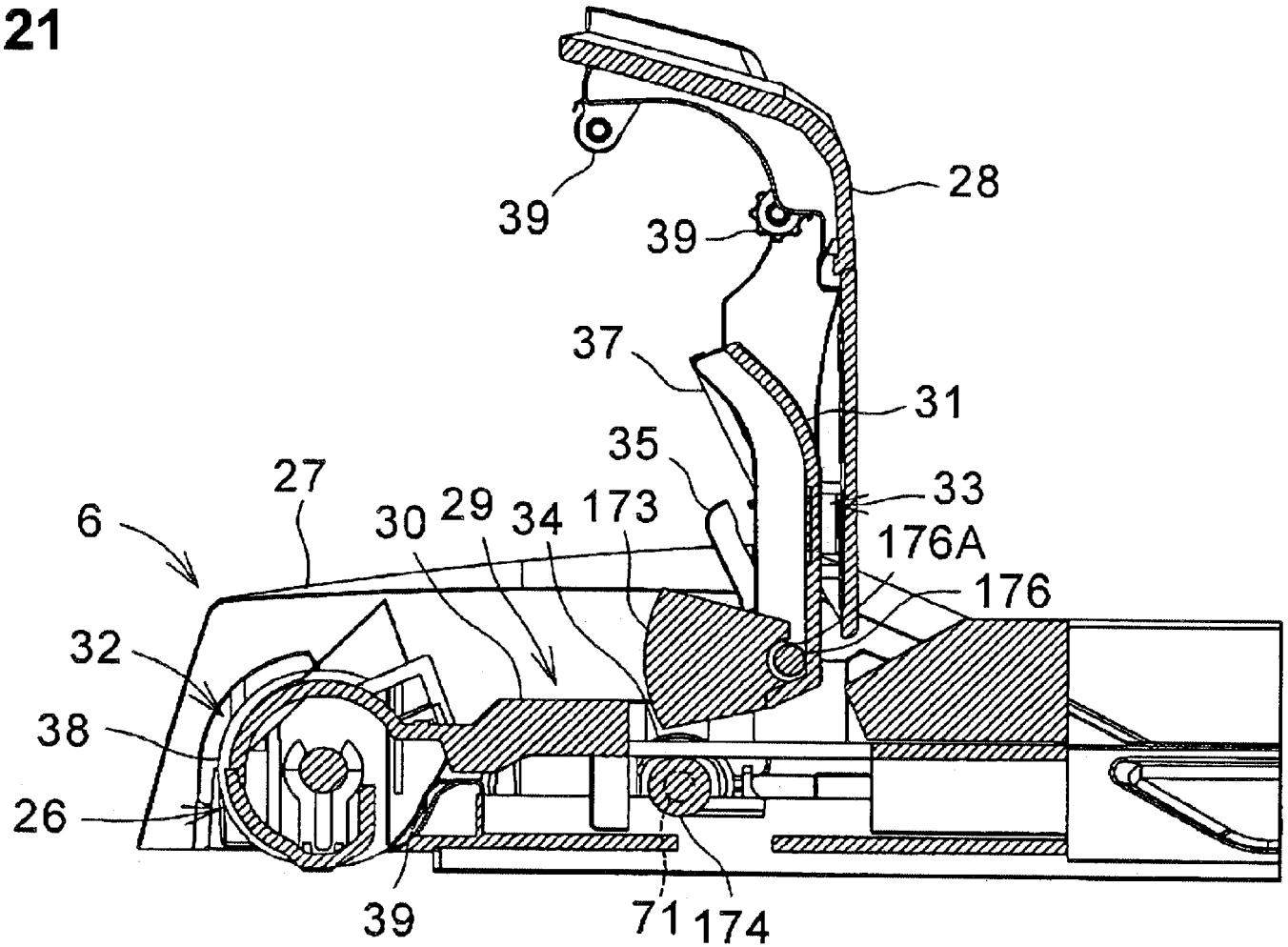
FIG. 21 is a sectional view of the ADF when the ADF cover is open, taken along the line B-B of FIG. 1, according to the fifth embodiment of the present invention.
Figure 22:
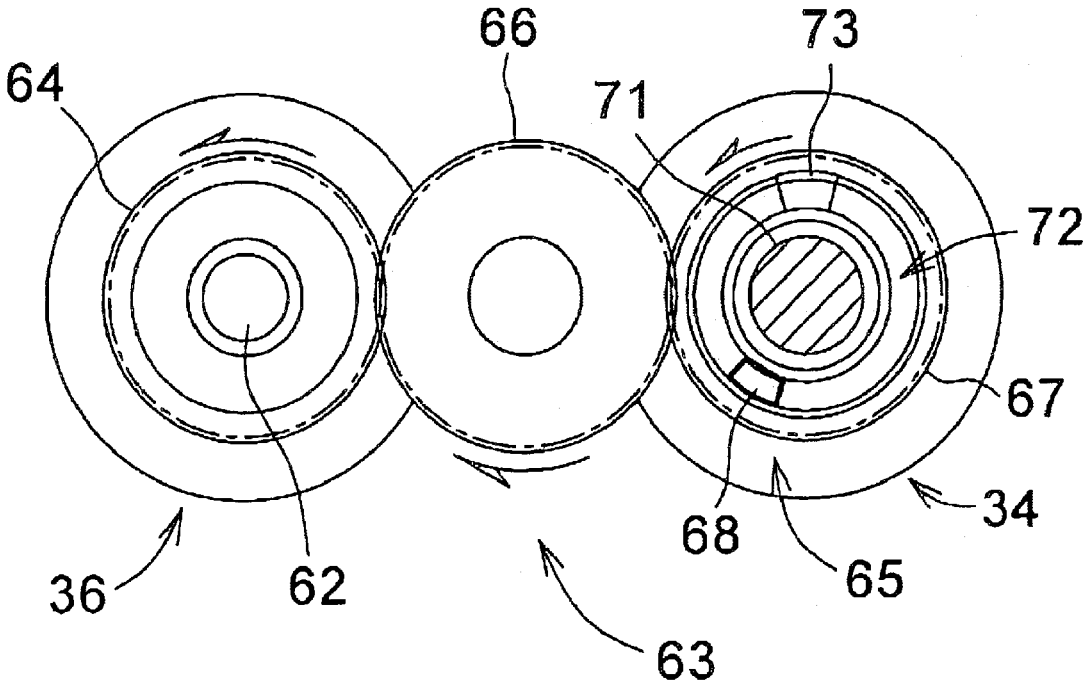
FIG. 22 is a schematic view of the drive transmission mechanism in a state where the pickup roller is rotated idle according to the fifth embodiment of the present invention.

As shown in FIGS. 20 and 21, the bearing 176A of the ADF cover 28 may be disposed on an upstream side with respect to the sheet feeding direction from the shaft 71 fixed to the gear 174. The ADF cover 28 pivots on the shaft 176 engaged with the bearing 176A, such that it opens and closes at its downstream side with respect to the sheet feeding direction.

The gear 173 provided in the ADF cover 28 may be fan shaped, such that it does not engage with the gear 174 whether the ADF cover 28 is closed or opened with respect to the ADF main body 27. When the ADF cover 28 is opened or closed, the gear 173 and the gear 174 engage with each other, and the rotation of the ADF cover 28 is transmitted to the shaft 71 of the pickup roller 34 via the gear 173 and the gear 174.

As described above, the bearing 176A of the ADF cover 28 may be disposed upstream from the shaft 71 with respect to the sheet feeding direction. To hold the ADF cover 28 in the closed position, the ADF cover 28 may rotate counterclockwise. The gear 173 also rotates on the shaft 176 engaging with the bearing 176A counterclockwise along with the ADF cover 28, and the gear 174 in engagement with the gear 173 rotates in the direction opposite to the sheet feeding direction, e.g., clockwise. The gear 173 and the gear 174 may be disposed, such that a rotation direction to hold the ADF cover 28 in the closed position and a direction to rotate the pickup roller 34 in the direction opposite to the sheet feeding direction are opposite. Thus, the motion transmission mechanism may be relatively simple.

When the ADF cover 28 is opened, e.g., to clear a paper jamming in the feed path 26 or to perform maintenance inside the ADF 5, the user may touch the pickup roller 34, resulting in the pickup roller 34 rotating. As shown in FIG. 21, when the ADF cover 28 is held in the open position, the guide plate 30 and the partition plate 31 are spaced apart, the pickup-side chute portion 29 and the curved portion 32 are opened, and the pickup roller 34 and the pickup-side nip member 35 are spaced apart. The roller surface of the pickup roller 34 is exposed from the guide plate 30, and the pickup roller 34 is able to rotate idle about one turn. Thus, the user may touch the pickup roller 34, e.g., inadvertently, and the pickup roller 34 rotates easily by such a contact.

Figure 23:
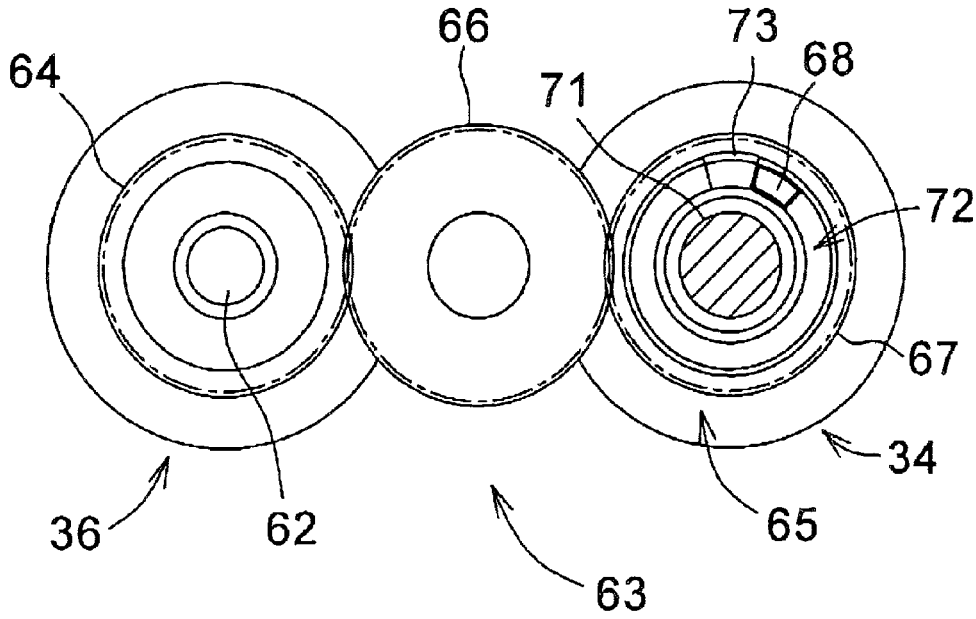
FIG. 23 is a schematic view showing the drive transmission mechanism in a state where the pickup roller is rotated idle according to the fifth embodiment of the present invention.

For example, an assumption may be made that during paper jam clearing or maintenance, the pickup roller 34 is rotated idle until the engaging member 68 contacts the engagement portion 73 of the clutch gear 67, or an end of the engagement groove 72 of the clutch 65 with respect to the sheet feeding direction, as shown in FIG. 23. If documents are set in the input tray 22 under the contact condition, when the documents make contact with the pickup roller 34, the user may feel resistance because the pickup roller 34 cannot be rotated idle in the sheet feeding direction, and may incorrectly determine that the document insertion is completed.

Thus, when the ADF cover 28 is closed from the condition that the pickup roller 34 is rotated idle, the gear 173 rotates along with the ADF cover 28, and the gear 173 and the gear 174 engage with each other as shown in FIG. 19. Accordingly, the rotation of the ADF cover 28 is transmitted to the shaft 71 of the pickup roller 34 via the gear 173 and the gear 174.

During the closing of the ADF cover 28, the gear 173 rotates on the shaft 176 counterclockwise, and the gear 174 in engagement with the gear 173 rotates clockwise. Thus, the pickup roller 34 also rotates along with the shaft 71 or in the direction opposite to the sheet feeding direction, e.g., clockwise. As shown in FIG. 23, the engagement portion 73 may not exist on the clockwise side of the engaging member 68. Thus, the engaging member 68 may rotate clockwise while sliding in the engagement groove 72 of the clutch gear 67.

When the ADF cover 28 is held in the open position, the engaging member 68 contacts the counterclockwise side of the engagement portion 73 of the clutch gear 67. The engaging member 68 returns to the end of the engagement groove 72 of the clutch 65 with respect to the direction opposite to the sheet feeding direction. Thus, when documents are set in the input tray 22 after the ADF cover 28 is held in the closed position, the pickup roller 34 may rotate idle for about one turn in the sheet feeding direction, e.g., counterclockwise. With this structure, it is possible to set documents in the input tray 22 by inserting them into the pickup-side chute portion 29 until their leading ends contact the separation roller 36 and the separation nip member 37.

The gear 173 provided in the ADF cover 28 may have a gear ratio that provides the gear 174 with a sufficient amount of rotation to slide the pickup roller 34 to the end of the groove 72 with respect to the direction opposite to the sheet feeding direction. In addition, during a paper jam clearing or maintenance, the pickup roller 34 may reach the end of the engagement groove 72 of the clutch 65 with respect to the direction opposite to the sheet feeding direction before the ADF cover 28 is completely held in the closed position, depending on the amount of movement the pickup roller 34 that is rotated idle. Furthermore, even if the pickup roller 34 is rotated idle when the ADF cover 28 is opened for a paper jam clearing or other purposes, the pickup roller 34 returns to the end of the engagement groove 72 of the clutch 65 with respect to the direction opposite to the sheet feeding direction in response to the closing motion of the ADF cover 28. Thus, document setting in the input tray 22 may be done reliably.

When the leading end of the document set on the input tray 22 is inserted into the pickup-side chute portion 29, the pickup roller 34, which is in contact with the leading end of the document, may rotate idle for about one turn. When the leading end of the document passes the position where the pickup roller 34 is disposed, the user may insert the document by the insertion limit position with little or no resistance. Thus, the document set in the input tray 22 may be fed in the sheet feeding direction upon the rotation of the pickup roller 34, such that the document is supplied in the feed path 26 with reliability.

In addition, it is possible to pull out the document set in the input tray 22 with little or no resistance, and the document will not be damaged at that time. If the ADF cover 28 is opened for clearing of a paper jam or maintenance and the pickup roller 34 is caused to rotate idle, the torsion coil spring 69 causes the pickup roller 34 to return to the end of the engagement groove 72 of the clutch 65 with respect to the direction opposite to the sheet feeding direction. Thus, document setting thereafter in the input tray 22 may be done with reliability.

In a sixth embodiment of the present invention, the gear 173 of the fifth embodiment is changed, however, the other components of the sixth embodiment are the same as those in the fifth embodiment. Therefore, only the changes to the gear 173 are described with respect to the sixth embodiment.

Figure 24:
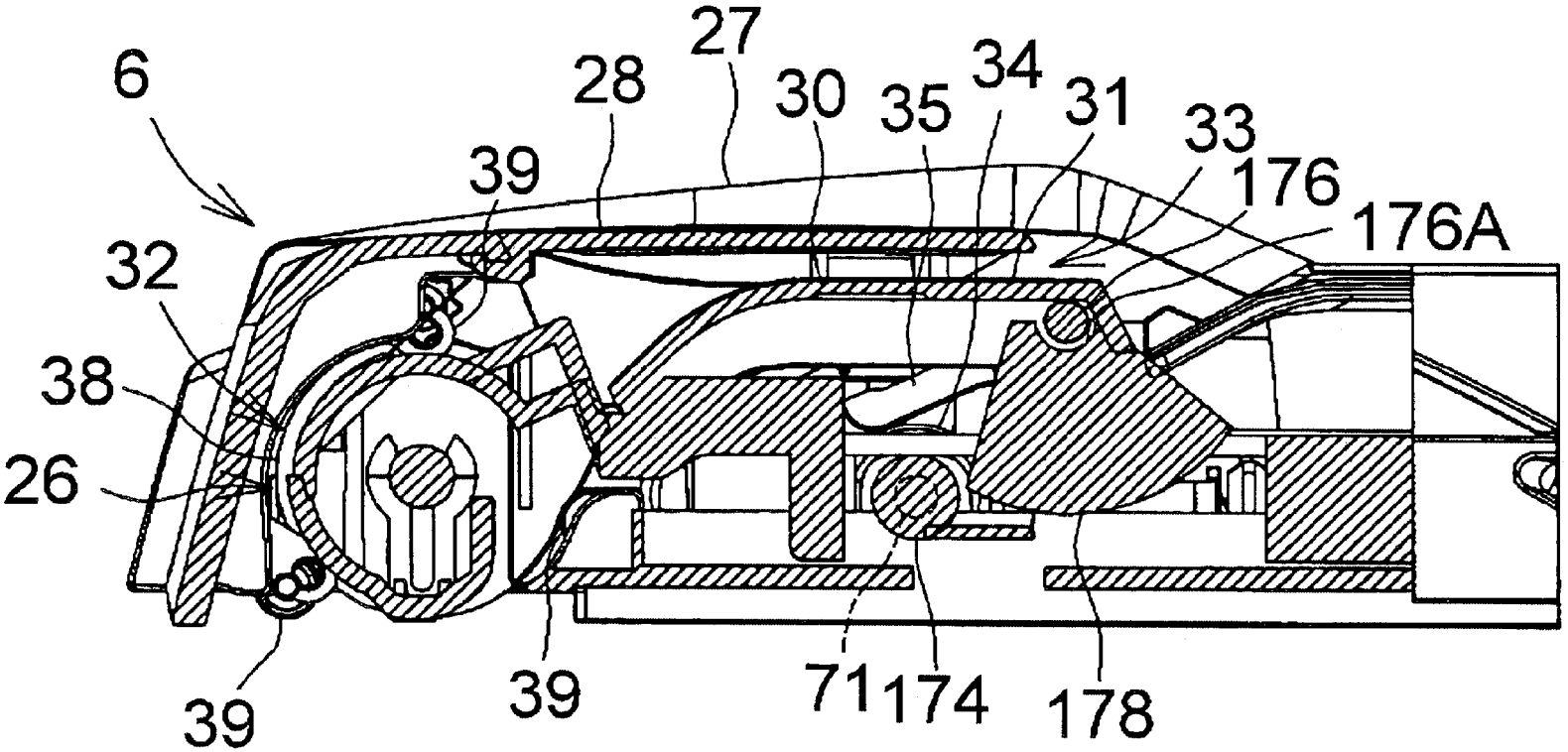
FIG. 24 is a sectional view of the ADF when the ADF cover is closed, taken along the line B-B of FIG. 1, according to a sixth embodiment of the present invention.
Figure 25:
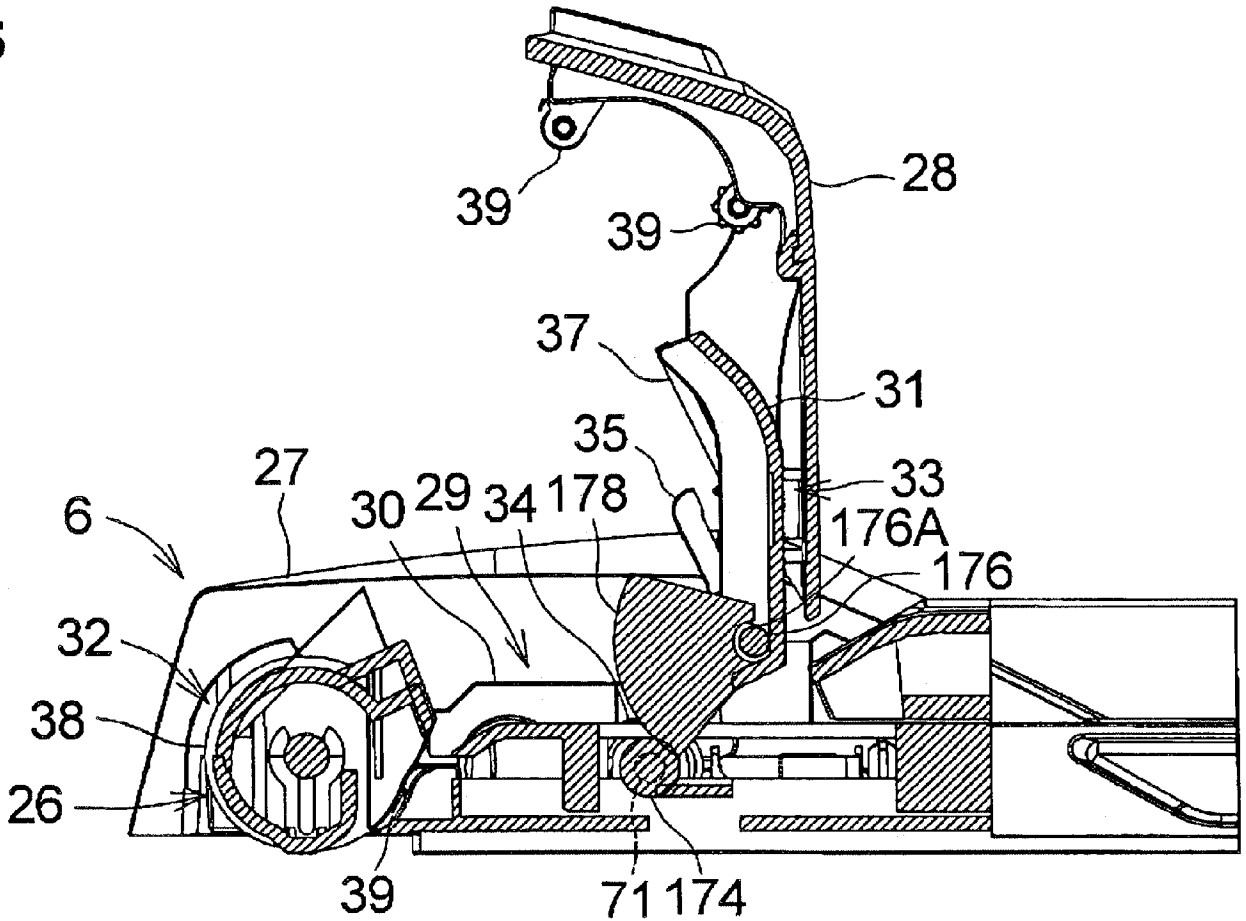
FIG. 25 is a sectional view of the ADF when the ADF cover is open, taken along the line B-B of FIG. 1, according to the sixth embodiment of the present invention.

As shown in FIGS. 24 and 25, the ADF cover 28 may be provided with a gear 178 instead of the gear 173. The gear 178 may have the shape of a fan and may be coaxially formed with the bearing 176A of the ADF cover 28, and may comprise a spur gear having teeth that are parallel to its axis on its circumference. The gear 178 may be integrally formed with the bearing 176A provided at one side of the ADF cover 28 so as to protrudes substantially downward from the ADF cover 28. The gear 178 rotates around the shaft 176 along with the opening/closing motion of the ADF cover 28.

The gear 178 may be fan-shaped so that it does not engage with the gear 174 when the ADF cover 28 is closed with respect to the ADF main body 27 as shown in FIG. 24, but engages with the gear 174 when the ADF cover 28 is opened as shown in FIG. 25. Of course, the gear 178 and the gear 174 engage with each other during the opening/closing motion of the ADF cover 28. Thus, even when the ADF cover 28 is held in the open position, the shaft 71 of the pickup roller 34 and the ADF cover 28 work in combination with each other.

With this structure, to rotate the pickup roller 34 even if the user opens the ADF cover 28 for paper jam clearing or maintenance, and touches the pickup roller 34, the ADF cover 28 rotates along with the pickup roller 34 or a load to slide the torque limiter 75. Thus, the pickup roller 34 does not rotate just when it is touched, e.g., accidentally, by the user. When the ADF cover 28 is held in the closed position, the pickup roller 34 moves to the end of the engagement groove 72 of the clutch 65 with respect to the direction opposite to the sheet feeding direction, and document setting thereafter in the input tray 22 may be done with reliability.

In a seventh embodiment, the motion transmission mechanism of the fifth embodiment is changed, however, the other components of the seventh embodiment are the same as those in the fifth embodiment. Therefore, only the changes to the motion transmission mechanism are described with respect to the seventh embodiment.

Figure 26:
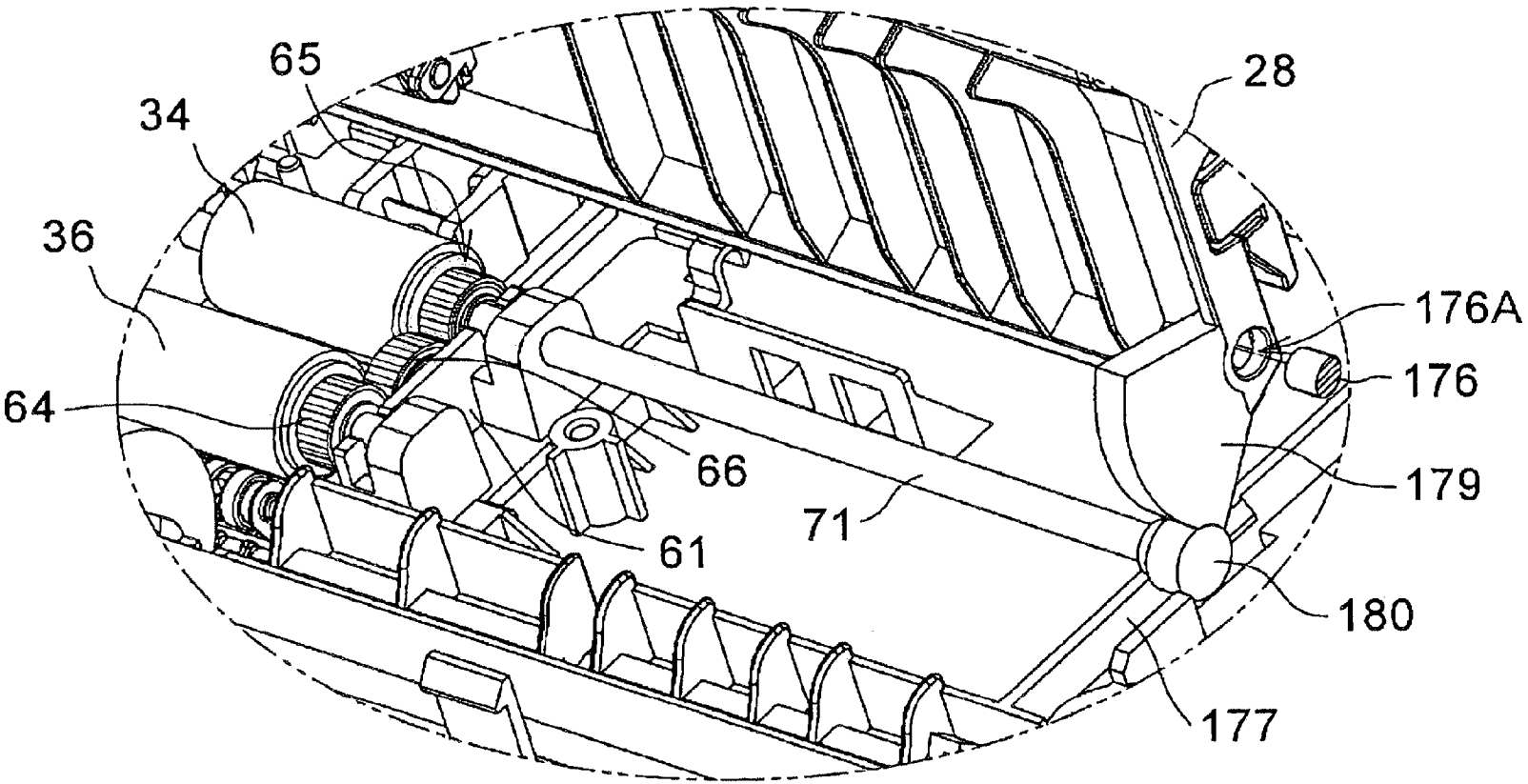
FIG. 26 is an enlarged, perspective view of a motion transmission mechanism according to a seventh embodiment of the present invention.

A motion transmission mechanism of this embodiment may comprise a frictional transmission type. Specifically, the motion transmission mechanism of this embodiment may be used to rotate the pickup roller 34 to the end of the engagement groove 72 of the clutch 65 with respect to the direction opposite to the sheet feeding direction based on the closing motion of the ADF cover 28 held in the open position. As shown in FIG. 26, the motion transmission mechanism may comprise a fan-shaped member 179 (a first motion transmission member) provided at the ADF cover 28, and a cylindrical member 180 (a second motion transmission member) provided around the shaft 71 of the pickup roller 34.

The fan-shaped member 179 may be coaxially formed with the bearing 176A of the ADF cover 28, and a circumference thereof may be a frictional transmission surface. The fan-shaped member 179 may be integrally formed with the bearing 176A provided at one side of the ADF cover 28 so as to protrude substantially downward from the ADF cover 28. The fan-shaped member 179 rotates around the shaft 176 along with the opening/closing motion of the ADF cover 28.

The cylindrical member 180 may be provided at one end of the shaft 71 of the pickup roller 34 so as to press into contact with the fan-shaped member 179, and a circumference thereof may be a frictional transmission surface. The cylindrical member 180 may be formed in a D-shape at an engaged portion with the shaft 71 to rotate integrally with the shaft 71.

As described above, when the ADF cover 28 is opened to clear a paper jamming in the feed path 26 or to perform maintenance inside the ADF 5, the user may touch the pickup roller 34, resulting in the pickup roller 34 rotating. However, if the ADF cover 28 is closed in the condition in which the pickup roller 34 has been rotated idle, the fan-shaped member 179 rotates along with the motion of the ADF cover 28 and presses against the cylindrical member 180, as shown in FIG. 26. As a result, the rotational motion of the ADF cover 28 may be frictionally transmitted to the shaft 71 of the pickup roller 34 via the fan-shaped member 179 and the cylindrical member 180.

Figure 16:
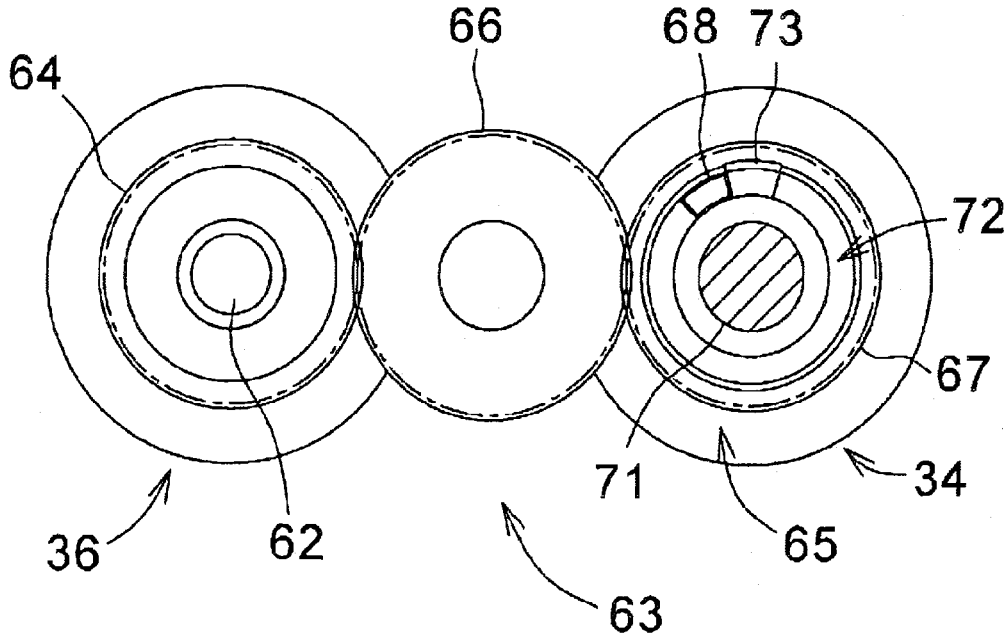
FIG. 16 is a schematic view of the drive transmission mechanism according to a fifth embodiment of the present invention.
Figure 17:
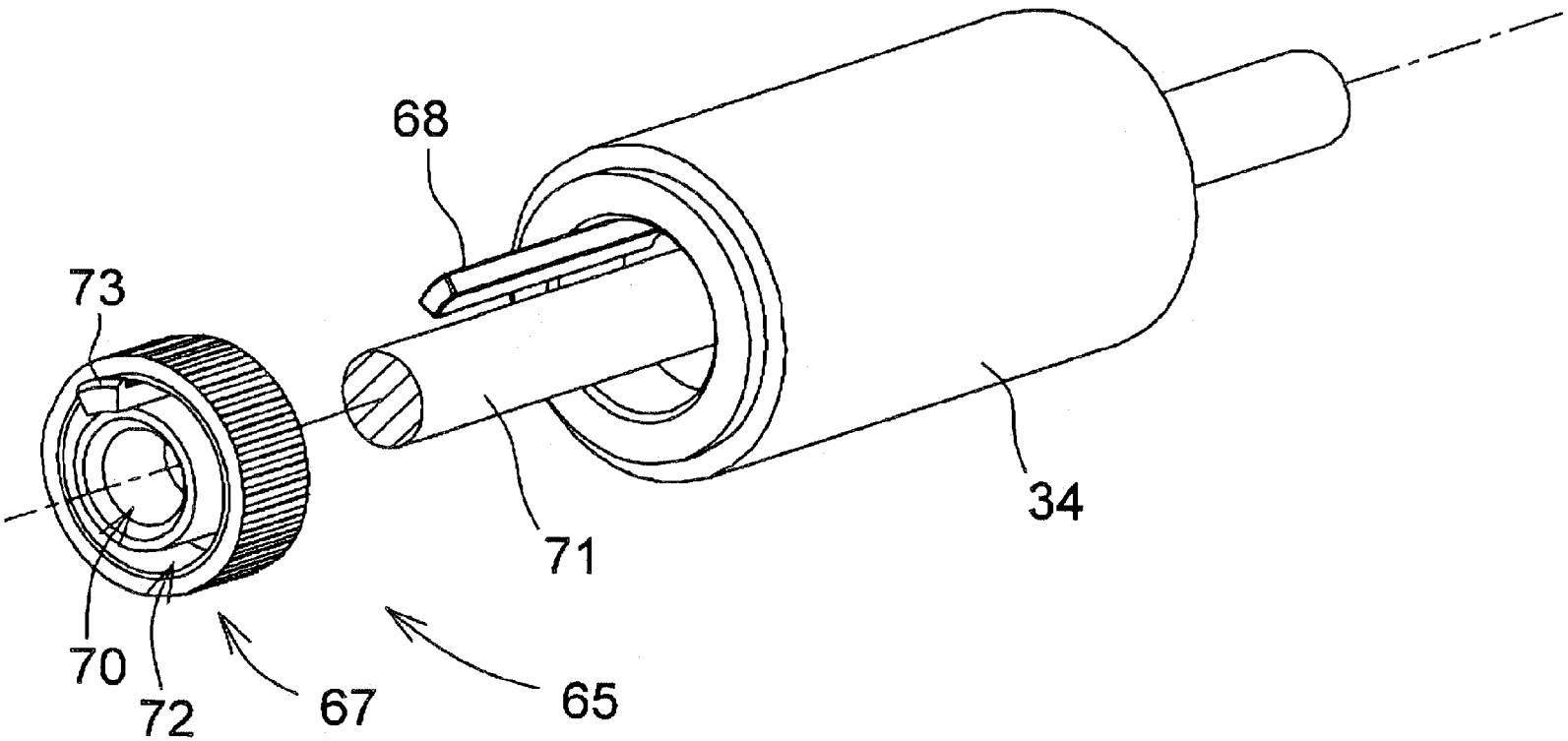
FIG. 17 is an exploded, perspective of a clutch according to a fifth embodiment of the present invention.
Figure 18:
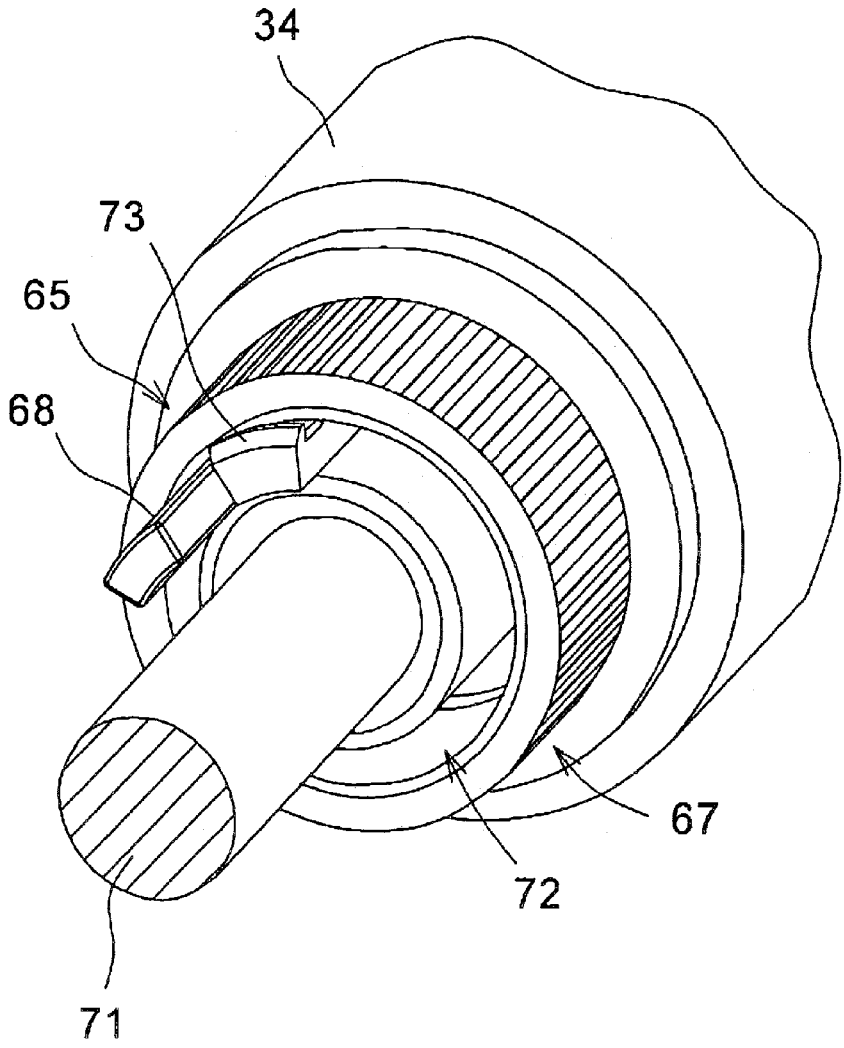
FIG. 18 is an enlarged, perspective view of the clutch according to the fifth embodiment of the present invention.

During the closing motion of the ADF cover 28, the fan-shaped member 179 rotates on the shaft 176 counterclockwise, while the cylindrical member 180 pressed in contact with the fan-shaped member 179 rotates clockwise. Consequently, the pickup roller 34 also rotates clockwise along with the shaft 71. When the ADF cover 28 is held in the closed position, the pickup roller 34 returns to the end of the engagement groove 72 of the clutch 65 with respect to the direction opposite to the sheet feeding direction, as shown in FIG. 16. Thus, when documents are set in the input tray 22 after the ADF cover 28 is held in the closed position, the pickup roller 34 is able to rotate idle for about one turn in the sheet feeding direction or counterclockwise. With this structure, it is possible to set documents in the input tray 22 by inserting them into the pickup-side chute portion 29 until their leading ends make contact with the separation roller 36 and the separation nip member 37.

During a paper jam clearing or maintenance, the pickup roller 34 may reach the end of the engagement groove 72 of the clutch 65 with respect to the direction opposite to the sheet feeding direction before the ADF cover 28 is completely held in the closed position, depending on the amount of movement the pickup roller 34 rotated idle. As the pickup roller 34 is subject to load of the drive mechanism via the clutch gear 67, the fan-shaped member 179 and the cylindrical member 180 slip, and the frictional transmission is interrupted. Thus, the pickup roller 34, which remains at the end of the engagement groove 72 of the clutch 65 with respect to the direction opposite to the sheet feeding direction, may be rotated until the ADF cover 28 is held in the closed position.

In addition, the fan-shaped member 179 may be designed so that it does not contact the cylindrical member 180 when the ADF cover 28 is completely closed with respect to the ADF main body 27 but presses against the cylindrical member 180 when the ADF cover 28 is opened with respect to the ADF main body 27.

With this structure, to rotate the pickup roller 34 even if the user opens the ADF cover 28 for a paper jam clearing or maintenance and touches the pickup roller 34, the ADF cover 28 may be rotated along with the pickup roller 34 or a load to slide the fan-shaped member 179 and the cylindrical member 180 should be applied. Thus, the pickup roller 34 does not rotate just when it is touched by the user. When the ADF cover 28 is held in the closed position, the pickup roller 34 moves to the end of the engagement groove 72 of the clutch 65 with respect to the direction opposite to the sheet feeding direction, and document setting thereafter in the input tray 22 may be done with reliability, as described above.

In the eighth embodiment, the return mechanism embodied in the motion transmission mechanism of the fifth embodiment is realized by software, and the other components of the eighth embodiment are the same as those in the fifth embodiment. Therefore, only the changes to the return mechanism are described with respect to the eighth embodiment.

As described above, the ADF cover 28 may be openable/closable with respect to the ADF main body 27. The opening/closing of the ADF cover 28 may be detected by the cover sensor 59, as shown in FIG. 5. The cover sensor 59 may comprise a known sensor, such as an optical sensor or a magnet sensor.

The return mechanism of this embodiment may comprise the controller 45, and may be used to control rotation of the drive mechanism, such that when the ADF cover 28 is held in the closed position, the pickup roller 34 is positioned to the end of the engagement groove 72 of the clutch 65 with respect to the direction opposite to the sheet feeding direction.

Figure 27:
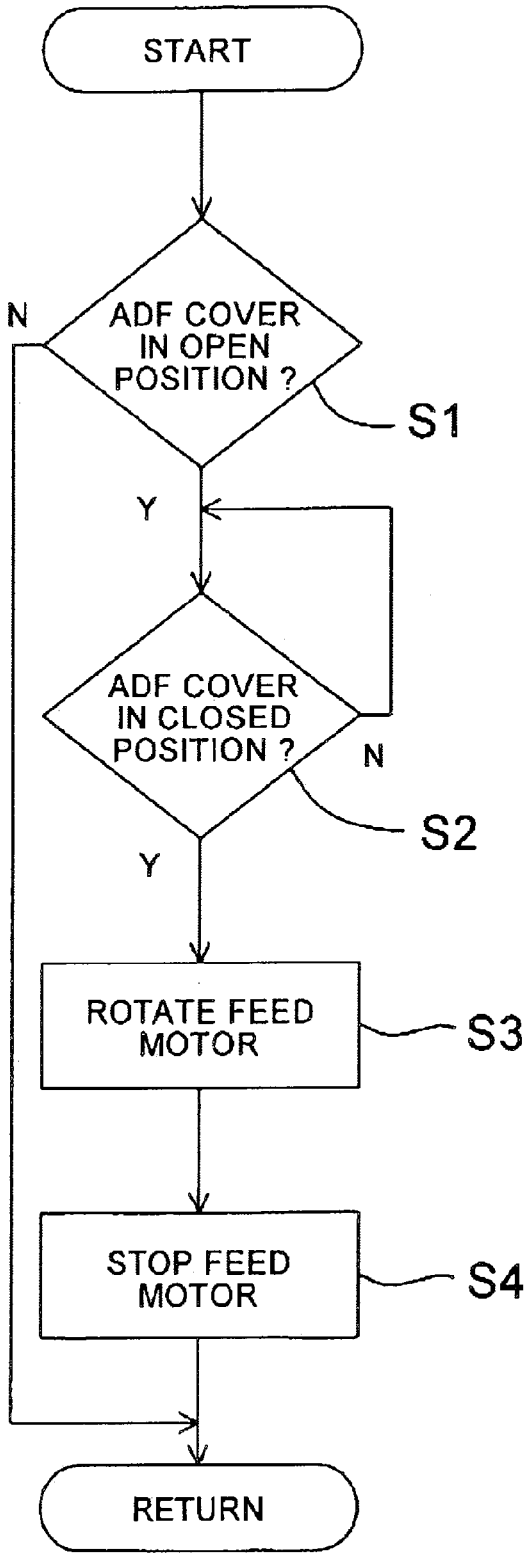
FIG. 27 is a flowchart showing sheet feeder operation according to an eighth embodiment of the present invention.

FIG. 27 is a flowchart showing a control of the drive mechanism by the controller 45. The ADF 5 in the scanner portion 2 includes no documents in the input tray 22 and waits for document setting and start of image reading.

When the ADF cover 28 is opened from this condition for a paper jam clearing or maintenance inside the ADF 5, the cover sensor 59 detects that the ADF cover 28 is in the open position (S1). The user performs paper jam clearing or maintenance with the ADF cover 28 open. At this time, the pickup roller 34 is able to rotate idle for about one turn in the engagement groove 72 of the clutch 65, and thus may be touched, e.g., accidentally, by the user and rotated idle until it reaches the end of the engagement groove 72 of the clutch 65 with respect to the sheet feeding direction, as shown in FIG. 23.

In this way, when the ADF cover 28 is closed from the condition that the pickup roller 34 has been rotated idle, the cover sensor 59 detects that the ADF cover 28 is in the closed position (S2). The controller 45 receives the detection signal and causes the feed motor 52 to rotate via the drive circuit 53 for a predetermined time (S3).

When the rotation of the feed motor 52 is transmitted to the shaft 62 of the separation roller 36, the gear 64 rotates along with the shaft 62 in the sheet feeding direction, e.g., counterclockwise in FIG. 23. Then, the drive transmission gear 66 in engagement with the gear 64 rotates clockwise, and the clutch gear 67 in engagement with the gear 66 rotates counterclockwise. As shown, the engaging member 68 is not on the counterclockwise side of the engagement portion 73 of the clutch gear 67 and the clutch gear 67 rotates with respect to the shaft 71 of the pickup roller 34 so as to slide the engaging member 68 in the engagement groove 72. Specifically, with the pickup roller 34 standing still, the clutch gear 67 only rotates counterclockwise.

When the clutch gear 67 rotates for about one turn, the engagement portion 73 of the clutch gear 67 contacts the counterclockwise position of the engaging member 68 as shown in FIG. 16. Specifically, the engaging member 68 returns to the end of the engagement groove 72 of the clutch 65 with respect to the direction opposite to the sheet feeding direction. Furthermore, when the feed motor 52 is rotated, the rotation is transmitted from the engagement portion 73 to the engaging member 68, and the pickup roller 34 rotates or in the sheet feeding direction, e.g., counterclockwise.

In this way, after the feed motor 52 is rotated for a sufficient time to allow the pickup roller 34 to return to the end of the engagement groove 72 of the clutch 65 with respect to the direction opposite to the sheet feeding direction, the controller 45 stops the rotation of the feed motor 52 (S4), and then returns to a standby status for document setting and image reading start.

Thus, when documents are set in the input tray 22 after the ADF cover 28 is held in the closed position, the pickup roller 34 is able to rotate idle for about one turn in the sheet feeding direction, e.g., counterclockwise. Documents may be set in the input tray 22 in such a manner that leading ends of the documents with respect to the sheet feeding direction are inserted into the pickup-side chute portion 29.

While the invention has been described in connection with preferred embodiments, it will be understood by those skilled in the art that other variations and modifications of the preferred embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. A sheet feeder, comprising:

an input tray configured to hold a plurality of sheets therein;

a first roller configured to contact and to feed the plurality of sheets one by one in a sheet feeding direction to a feed path;

a first contact member configured to apply a pressure to the plurality of sheets in a direction toward the first roller;

a second roller disposed on a downstream side of the first roller, wherein the second roller is configured to feed the plurality of sheets fed by the first roller further in the sheet feeding direction;

a second contact member configured to contact the second roller and to separate the plurality of sheets fed by the first roller;

a motor configured to drive each of the first roller and the second roller;

a drive transmission mechanism configured to selectively transmit a driving force from the motor to each of the first roller and the second roller, wherein the drive transmission mechanism comprises a clutch configured to enable the first roller to rotate within a predetermined range of rotation in the sheet feeding direction during an idle condition; and a return mechanism configured to enable the first roller to rotate within the predetermined range of rotation in a direction that is opposite to the sheet feeding direction.

2. The sheet feeder according to claim 1, wherein a length of the predetermined range of rotation is substantially equal to a distance between the first roller and the second roller.

3. The sheet feeder according to claim 1, wherein the clutch is disposed around a shaft of the first roller.

4. The sheet feeder according to claim 1, wherein at least one of the first contact member and the second contact member comprises a pad.

5. The sheet feeder according to claim 1, wherein the return mechanism comprises an elastic member that elastically urges the first roller toward an end of the predetermined range of rotation.

6. The sheet feeder according to claim 5, wherein the elastic member comprises a torsion coil spring.

7. The sheet feeder according to claim 5, wherein the first contact member is does not contact the first roller.

8. The sheet feeder according to claim 7, wherein the first contact member comprises a pad that faces the first roller, and the pad has a cutout portion formed therethrough to prevent contact between the contact member and the first roller.

9. The sheet feeder according to claim 7, wherein the first contact member holds the plurality of sheets at both ends with respect to an axial direction of the first roller.

10. The sheet feeder according to claim 7, wherein the first roller comprises a pair of first rollers that are spaced from each other on a same axis line and hold the plurality of sheets.

11. The sheet feeder according to claim 5, wherein the first contact member contact the first roller, and the sheet feeder further comprises a separation mechanism that separates the first contact member from the first roller, and the separation mechanism is configured to return the first roller to the end of the predetermined range of rotation when the first contact member is separated from the first roller.

12. The sheet feeder according to claim 11, wherein the separation mechanism comprises a cover disposed where the first contact member and the second contact member are attached, wherein the cover is configured to open and to close.

13. The sheet feeder according to claim 1, further comprising a cover member disposed where at least the first contact member is attached, the cover member being configured to cause the first roller to rotate to the end of the predetermined range of rotation based on a closing motion of the cover member from an open position thereof.

14. The sheet feeder according to claim 13, wherein the return mechanism comprises a motion transmission mechanism configured to transmit a rotational motion during the closing motion of the cover member to the first roller.

15. The sheet feeder according to claim 14, wherein the motion transmission mechanism comprises a first motion transmission gear coupled to the cover member and configured to rotate with the cover member, a second motion transmission gear configured to engage the first motion transmission gear during the closing motion of the cover member, and a friction clutch configured to transmit a rotation of the second motion transmission gear to the first roller.

16. The sheet feeder according to claim 15, wherein the first motion transmission gear and the second motion transmission gear engage each other when the cover member is held in the open position.

17. The sheet feeder according to claim 15, wherein the cover member comprises a rotary shaft disposed on an upstream side with respect to the sheet feeding direction from the second motion transmission gear and pivots on the rotary shaft, wherein the cover member opens and closes at a downstream side thereof with respect to the sheet feeding direction.

18. The sheet feeder according to claim 14, wherein the motion transmission mechanism comprises a first motion transmission member coupled to the cover member and configured to rotate with the cover member, and a second motion transmission provided coaxially with the first roller, wherein the second motion transmission is configured to engage the first motion transmission gear and to receive a rotational force from the first motion transmission member via friction between the first motion transmission member and the second motion transmission member.

19. The sheet feeder according to claim 18, wherein the first motion transmission member and the second motion transmission member are in frictional contact with each other when the cover member is held in the open position.

20. The sheet feeder according to claim 18, wherein the cover member comprises a rotary shaft disposed on an upstream side with respect to the sheet feeding direction from the second motion transmission member and pivots on the rotary shaft, wherein the cover member opens and closes at a downstream side thereof with respect to the sheet feeding direction.

21. The sheet feeder according to claim 13, wherein the returning mechanism comprises a controller for controlling the motor to return the first roller to the end of the predetermined range of rotation.

22. The sheet feeder according to claim 21, wherein the controller drives the motor in the sheet feeding direction for a predetermined period of time when a cover sensor detects that the cover member is opened and then is held in the closed position.

23. The sheet feeder according to claim 1, further comprising a third roller disposed on a downstream side from the second roller, wherein the third roller has a circumferential velocity that is greater than a circumferential velocity of the first roller, and the first roller returns to the end of the predetermined range of rotation when one of the plurality sheets is fed by the first roller and the third roller.

24. The sheet feeder according to claim 1, wherein the predetermined range of rotation is about one turn of the first roller.

25. A sheet feeder, comprising:

a roller configured to feed a plurality of sheets one by one in a sheet feeding direction to a feed path;

a motor configured to drive the roller;

a drive transmission mechanism configured to transmit a driving force from the motor to the roller, wherein the drive transmission comprises a clutch configured to enable the roller to rotate within a predetermined range of rotation in the sheet feeding direction during an idle condition; and a return mechanism configured to enable the roller to rotate within the predetermined range of rotation in a direction that is opposite to the sheet feeding direction.

* * * * *